United States Patent [19]

Ohashi et al.

[11] Patent Number: 4,600,733

[45] Date of Patent: Jul. 15, 1986

[54] DISINTEGRATION ASSISTANT FOR CASTING MOLDS

[75] Inventors: Keizi Ohashi, Urayasu; Kazuo Takahashi, Yokohama, both of Japan

[73] Assignee: Nissan Motor Co., Ltd., Yokohama, Japan

[21] Appl. No.: 706,753

[22] Filed: Feb. 28, 1985

[30] Foreign Application Priority Data

Feb. 29, 1984 [JP] Japan ..... 59-37473

[51] Int. Cl.[4] ..... B22C 11/22

[52] U.S. Cl. ..... 523/144; 523/139; 523/145; 523/146; 523/147; 524/424; 524/425; 524/456

[58] Field of Search ..... 523/144, 145, 146, 147, 523/139; 524/456, 424, 425

[56] References Cited

U.S. PATENT DOCUMENTS

| | | | |
|---|---|---|---|
| 3,645,491 | 2/1972 | Brown et al. | 524/424 |
| 4,321,186 | 3/1982 | Allison | 524/424 |
| 4,459,376 | 7/1984 | Matsushima et al. | 523/145 |

FOREIGN PATENT DOCUMENTS

| | | |
|---|---|---|
| 0006721 | 1/1980 | European Pat. Off. . |
| 50-104721 | 8/1975 | Japan . |
| 777065 | 6/1957 | United Kingdom . |
| 834876 | 5/1960 | United Kingdom . |
| 1250849 | 10/1971 | United Kingdom . |

OTHER PUBLICATIONS

The Condensed Chemical Dictionary, 7th Edition; Reinhold Pub. Corp.; 1966; pp. 97, 98, 162, 165.

Patent Abstracts of Japan, vol. 8, No. 189, Aug., 1984; Japanese Application No. 59-78746.

Patent Abstracts of Japan, vol. 7, No. 163, Jul., 1983; Japanese Application No. 58-70939.

*Primary Examiner*—Lewis T. Jacobs

*Attorney, Agent, or Firm*—Schwartz, Jeffery, Schwaab, Mack, Blumenthal & Evans

[57] ABSTRACT

A disintegration assistant is added to a molding composition made up of foundry sand and a binder whose major part is a condensation-reactive compound or resin having methylol groups in a molecule. The molding composition is formed into a mold and a core by solidifying the resin so that individual grains of the foundry sand are bound each other. The disintegration assistant is mainly made of calcium hydroxide, calcium carbonate, barium hydroxide and/or barium carbonate, thereby promoting the heat deterioration of the resin to improve the disintegration characteristics of the mold and the core.

6 Claims, No Drawings

DISINTEGRATION ASSISTANT FOR CASTING MOLDS

BACKGROUND OF THE INVENTION

1. Field of the Invention

This invention relates to casting molds and cores of the type wherein foundry sand is bound with a binder whose major part is a condensation-reactive compound having methylol groups in a molecule, and more particularly to a disintegration assistant for improving the disintegration characteristics of the molds and cores after casting is completed.

2. Description of the Prior Art

In connection with conventional production techniques for molds and cores used in casting, shell molding has been commonly used in which the molds and the cores are formed by binding foundry sand, for example, with a binder of phenolic resin regardless of the kind of alloys to be casted. Particularly, the shell molding has been frequently used for production of the cores beqause of superiority in productivity and dimensional accuracy.

However, in case the core produced by the shell molding is used in casting of a light alloy having a relatively low melting point such as aluminum alloy, a part of phenolic resin is subjected to thermal change under the heat of molten metal thereby to form very rigid graphite structure, so that the residual strength of the core after casting is considerably high. Accordingly, in order to facilitate disintegration of the core, the core is heated together with a resulting casting product at a high temperature such as about 500° C. for a such long time as of 5 to 10 hours thereby to burn out the residue of the binder which has the graphite structure. This necessitates consumption of a large amount of energy. In this regard, it has been eagerly desired to develop a binder which is easily thermally decomposable to obtain molds and cores of high disintegration characteristics. From such view points, development of a variety of binders offering high disintegration characteristics to molds and cores has been extensively tried.

As a part of such development, investigation has been made on thermosetting resins containing no benzene ring, for example, unsaturated polyester and the like in view of the fact that formation of the graphite structure is due to the benzene ring of phenolic resin. However, such thermosetting resins are not sufficient in heat resistance as compared with phenolic resin and lower in hot strength. Furthermore, such thermosetting resins are too thermally decomposable, and accordingly gas defect is liable to arise when used for producing molds and cores, thereby lowering production yield of the molds and cores.

Moreover, from the view point of energy saving upon paying attention to the fact that heating is necessary to form molds and cores, i.e., to solidify the binder, studies have been made to obtain mold and core forming methods in which binders can be solidified at ordinary temperature. As one of these methods, so-called cold box method has been developed in which the combination of phenolic resin composition and isocyanate compound is used as the binder for foundry sand. However, phenolic resin is used also in this method, and therefore the disintegration characteristics of molds and cores after casting is inferior.

SUMMARY OF THE INVENTION

A disintegration assistant of the present invention is added to a molding composition including foundry sand and a binder of the type wherein a major part thereof is a condensation-reactive compound or resin having methylol groups in a molecule. The molding composition is formed into a mold and a core by solidifying the resin in which indivisual grains of the foundry sand are bound each other. The disintegration assistant is made of calcium hydroxide, calcium carbonate, barium hydroxide and/or barium carbonate. The disintegration assistant can increase the heat deterioration rate of the resin, thereby noticeably improving the disintegration characteristics of the mold and the core.

Furthermore, a compound generating gas upon heated between 200° C. and 400° C. is preferably added to the molding composition. Accordingly, the compound generates a large amount of gas when molten metal such as of aluminum is poured to the mold provided with the core, thereby obtaining higher disintegration characteristics even in case the shape of the mold and core is complicated.

DETAILED DESCRIPTION OF THE INVENTION

According to the present invention, a disintegration assistant for improving the disintegration characteristics of molds and cores formed of foundry sand with a binder, comprises calcium hydroxide, calcium carbonate, barium hydroxide, and/or barium carbonate, in which a major part of the binder is a condensation-reactive compound having at least one methylol group in a molecule.

Examples of the above-mentioned condensation-reactive compound having at least one methylol group in a molecule are phenol-formaldehyde resin, furfuryl alcohol-furfural copolycondensation resin, furfuryl alcohol resin, furfural-phenol copolycondensation resin, furfural-ketone copolycondensation resin, furfuryl alcohol-formaldehyde resin, furfuryl alcohol-urea-formaldehyde resin, furfuryl alcohol-phenol-urea-formaldehyde resin, furfuryl alcohol-phenol-formaldehyde resin, melamine-formaldehyde resin, urea-formaldehyde resin, resorcinol-formaldehyde resin, and the like. The above-mentioned compounds are used singly or may be used in combination of two or more.

The phenol-formaldehyde resin is one of phenolic resins and a thermosetting resin obtained, for example, by the condensation of phenol and formaldehyde in the presence of acid or alkali. One obtained by condensation using an acid as a condensing agent is called of novolak type, whereas one obtained using an alkali as a condensing agent is called of resol type. The novolak type phenolic resin requires a hardener in order to be hardened, in which hexamethylenetetramine is usually used as the hardener. The resol type phenolic resin is hardened only by being heated. As the condensation-reactive compound of the present invention, a mixture of the novolak and resol types of phenolic resins may be used, in which the hardener such as hexamethyl-enetetramine is not necessarily required so that the phenolic resin can be hardened upon heating. It is to be noted that the examples of the condensation-reactive compound of the present invention comprise furan resin which is a synthetic resin having furan rings and a thermosetting resin to be hardened upon heating. The furan resin may be hardened at ordinary temperature by using organic or inorganic acids.

Meant by the binder of the present invention is a composition comprising a major amount of the above-mentioned condensation-reactive compound (resin), and a minor amount of additives including a hardener, an assistant for improving slipping characteristics of resin coated sand which will be discussed after, an assistant such a silane coupling agent or a titanium coupling agent for improving the binding characteristics of the binder to foundry sand, and an inorganic filler other than silica sand.

The disintegration assistant of the present invention to be added to the binder comprises, in a major amount, calcium hydroxide $Ca(OH)_2$, calcium carbonate $CaCO_3$, barium hydroxide $Ba(OH)_2$, and/or barium carbonate $BaCO_3$. The disintegration assistant optionally comprises, in a minor amount, a compound capable of generating gas at a temperatures ranging from 200° C. to 400° C. It is supposed that when calcium hydroxide, calcium carbonate, barium hydroxide, and/or barium carbonate is added to the condensation-reactive compound (resin) having methylol groups in a molecule, the thermal deterioration rate of the compound (resin) is increased as compared with the compound (resin) without the disintegration assistant compound, thereby improving the disintegration characteristics of molds and cores, particularly of the cores. In the event that the compound capable of generating gas at 200°-400° C. is added to this sytem, a large amount of gas is generated when molten metal such as of aluminum alloy is poured to the molds, thereby further improving the disintegration characteristics of the cores while providing no effect to the thermal deterioration of the condensation-reactive compound (resin).

Calcium hydroxide to be used as the principal component of the disintegration assistant is generally called slaked lime, and prepared by the reaction between calcium oxide and water, or otherwise by adding alkali hydroxide to an aqueous solution of calcium salt. Calcium hydroxide is usually used singly as the principal component of the disintegration assistant and may be used in the form of being coated with lubricant such as natural wax, if necessary.

Calcium carbonate is usually prepared in the form of precipitation by adding alkali carbonate into an aqueous solution of the calcium salt. Calcium carbonate is industrially used, for example, in the form of so-called heavy calcium carbonate by pulverizing lime stone, and in the form of so-called light calcium carbonate prepared by reacting, under heating, carbon dioxide with milk of lime obtained by pulverizing lime stone.

Barium hydroxide is prepared by the reaction between barium oxide and water, and otherwise prepared as its octahydrate by the reaction between barium nitrate and a hot aqueous solution of sodium hydroxide and thereafter by being cooled. Barium oxide is readily soluble in water so that its octahydrate has a solubility of 4.181 g/100 g $H_2O$ (at 25° C.).

Barium carbonate naturally exists as witherite. Barium carbonate is prepared as precipitation by adding alkali carbonate to an aqueous solution of barium salt, and industrially otherwise prepared by introducing carbon dioxide to a hot aqueous solution of barium sulfide which is obtained by heating barite ($BaSO_4$) with carbon at 600°-800° C.

The above-described compounds are used singly or in combination of two as the principal component of the disintegration assistant. The proportion of the compound or the combination of the compounds used as the disintegration assistant principal component is within a range of from 0.5 to 35 parts by weight to 100 parts by weight of the above-mentioned condensation-reactive compound. If the proportion is less than 0.5 parts by weight, no improvement in the disintegration characteristics of molds and cores are recognized. It is recognized that the disintegration characteristics can be improved as the proportion increases. However, it is not preferable to increase the proportion over 35 parts by weight, because hardening of the condensation-reactive compound having methylol groups is promoted in the proportion over 35 parts by weight, thereby deteriorating the storing stability of resin coated foundry sand before producing molds and cores, while making difficult the unifrom mixing of the resin coated sand. This brings about a greater fluctuation in strength of resultant products or molds and cores, thereby making a wide range of dispersion of resultant product quality while making difficult the control of production process.

A large number of examples of the compound capable of generating gas at 200°-400° C. exist as azides, halides, oxides, cyanides, carbonates, nitrogen compounds, hydroxides, and the like. However, it is to be noted that ones of these compounds meeting the following requirements are preferable as the compound capable of generating gas at 200°-400° C.: (1) waste foundry sand after disintegration of molds and cores contains no harmful substance; and (2) a large amount of gas providing baneful influence to human bodies and casting products is not generated.

From this view point, examples of the compound capable of generating gas at 200°-400° C. are, as inorganic compounds, potassium permanganate, barium permanganate, potassium oxide, bismuth oxide, aluminum hydroxide, magnesium hydroxide, lanthanum hydroxide, zinc carbonate, sodium hydrogencarbonate, selenium oxide, and the like. Examples of the same compound are, as organic compounds, azodicarbonamide, D-glucose, L-sodium glutamate, dicyandiamide, d-potassium hydrogntartrate, sulfanilic acid, DL-methionine, n-quinonedioxime, n, n'-dibenzoyl quinonedioxime, and the like.

The compound capable of generating gas at 200°-400° C. is preferably used with or added to the disintegration assistant principal component in case a further high disintegration characteristics of molds and cores is required, for example, by the reason of complicated shapes of molds and cores. The compound capable of generating gas at 200°-400° C. is used within a proportion ranging from 0.5 to 35, preferably 5 to 15, parts by weight to 100 parts by weight of the above-mentioned condensation-reactive compound. If the proportion is less than 0.5 parts by weight, no improvement in the disintegration characteristics of molds and cores are recognized. It is recognized that the disintegration characteristics of molds and cores is improved as the proportion increases; however, a large amount of decomposition gas is generated thereby to cause gas defect in the event that the proportion is over 35 parts by weight.

The disintegration assistant of the present invention is added to the binder (binder composition) by usually used methods when resin coated foundry sand is prepared. That is to say, resin coated foundry sand is prepared usually by a method in which composition mixed with the disintegration assistant is added to silica sufficiently preheated and then mixed with each other so that the binder is coated on the surface of individual grains of the sand, or otherwise by another method in which the binder composition is dissolved and dispersed in organic solvent, water or the like, and mixed with silica sand and then dried. Furthermore, such resin coated foundry sand may be prepared by a further method in which the binder composition is added to and mixed with heated silica accompanying addition of the disintegration assistant with still continued stirring, and thereafter the resulting composition is cooled and dried. In order to produce a mold and a core by using resin coated foundry sand prepared by the above-mentioned methods, the resin coated sand is charged into a metal pattern which has been preheated at a temperature selected from a range of from 150° to 300° C. depending on the dimension and shape of the mold or the core and on the kind of the condensation-reactive compound as the principal component of the binder, and then baked or fired for 10 to 180 seconds. Otherwise, the mold and the core may be produced by solidifying the resin of the resin coated foundry sand at ordinary temperature by using organic acids or inorganic acids.

Illustration of the present invention will be now made by way of Examples, Comparative Examples, and Experiments.

EXAMPLE 1

Commercially available novolak type phenolic resin (designation "SP-1640" of Gunei Chemical Industry Co., Ltd.) was pulverized into powder, the phenolic resin being phenol-formaldehyde resin. Subsequently, 4.0 kg of silica sand (trade name "Nikko Keisa No. 6" of Kawatetu Mining Co., Ltd.) preheated to 160° C. was charged into a rotating sand mixer, and immediately thereafter a mixture of 80.0 g of the powdered novolak type phenolic resin and 0.4 g of calcium hydroxide (corresponding to 0.5 part by weight to 100 parts by weight of the phenolic resin) was added and stirred. At the time point the temperature of the silica sand reached 110° C., a 20 weight % concentration aqueous solution of 12 g of hexamethylenetetramine was added into the mixer. At the time point the resin had begun to solidify and the sand had become into its blocking state, 4.0 g of calcium stearate was added into the mixer, in which stirring was continued until the content became in its dried state in appearance, thereby preparing a resin coated foundry sand. In this case, the temperature of the sand lowered below the softening point of the resin at the point of stirring termination.

The above-described procedure was repeated seven times with the difference that the amount of calcium hydroxide was varied to 2.4 g (3 parts by weight), 4.0 g (5 parts by weight), 8.0 g (10 parts by weight), 12.0 g (15 parts by weight), 16.0 g (20 parts by weight), 24.0 g (30 parts by weight), and 28.0 g (35 parts by weight), respectively. Thus, eight batches of resin coated foundry sand were prepared.

EXAMPLE 2

Example 1 was repeated with the difference that sodium hydrogencarbonate was added in the amounts of 0.4 g (0.5 part by weight), 2.4 g (3 parts by weight), 4.0 g (5 parts by weight), 8.0 g (10 parts by weight), 12.0 g (15 parts by weight), 16.0 g (20 parts by weight), 24.0 g (30 parts by weight), and 28.0 g (35 parts by weight), respectively, to 80.0 g of novolak type phenolic resin and 8.0 g of calcium hydroxide. Thus, eight batches of resin coated foundry sand were prepared.

EXAMPLE 3

Example 1 was repeated with the difference that azodicarbonamide was added in the amounts of 0.4 g (0.5 part by weight), 2.4 g (3 parts by weight), 4.0 g (5 parts by weight), 8.0 g (10 parts by weight), 12.0 g (15 parts by weight), 16.0 g (20 parts by weight), 24.0 g (30 parts by weight) and, 28.0 g (35 parts by weight), respectively, to 80.0 g of novolak type phenolic resin and 8.0 g of calcium hydroxide. Thus, eight batches of resin coated foundry sand were prepared.

COMPARATIVE EXAMPLE 1

A single procedure of Example was repeated two times with the difference that the added amount of calcium hydroxide was varied to zero (none) and 32.0 g (40 parts by weight), respectively, thus preparing two batches of resin coated foundry sand.

COMPARATIVE EXAMPLE 2

A single procedure of Example 2 was repeated with the difference that the added amount of sodium carbonate was varied to 32.0 g (40 parts by weight), thereby preparing a single batch of resin coated foundry sand.

COMPARATIVE EXAMPLE 3

A single procedure of Example 3 was repeated with the difference that the added amount of azodicarbonamide was varied to 32.0 g (40 parts by weight), thus preparing a single batch of resin coated foundry sand.

EXAMPLE 4

Commercially available resol type phenolic resin (designation "PS-2176" of Gunei Chemical Industry Co., Ltd.) was pulverized into powder, the phenolic resin being phenol-formaldehyde resin. Subsequently, 6.0 Kg of silica sand (trade name "Nikko Keisa No. 6") preheated to 140° C. was charged into a rotating sand mixer, and immediately thereafter a mixture of 120.0 g of the powdered resol type phenolic resin and 0.6 g of calcium hydroxide (corresponding to 0.5 part by weight to 100 parts by weight of the phenolic resin) was added and stirred. At the time point the resin began to solidify and sand had become into its blocking state, 6.0 g of calcium stearate was added into the mixer, in which sterring was continued until the content of the mixer became in its dried state in appearance, thereby preparing a resin coated foundry sand. In this case, the temperature of the sand lowered below the softening temperature of the resin at the time point of sterring termination.

The above-described procedure was repeated seven times with the difference that the amount of calcium hydroxide was varied to 3.6 g (3 parts by weight), 6.0 g (5 parts by weight), 12.0 g (10 parts by weight), 18.0 g (15 parts by weight), 24.0 g (20 parts by weight), 36.0 g (30 parts by weight) and 42.0 g (35 parts by weight), respectively. Thus, eight batches of resin coated foundry sand were prepared.

EXAMPLE 5

Example 4 was repeated with the difference that zinc carbonate was added in the amount of 0.6 g (0.5 part by weight), 3.6 g (3 parts by weight), 6.0 g (5 parts by weight), 12.0 g (10 parts by weight), 18.0 g (15 parts by weight), 24.0 g (20 parts by weight), 36.0 g (30 parts by weight), and 42.0 g (35 parts by weight), respectively, to 120.0 g of the resol type phenolic resin and 12.0 g of calcium hydroxide. Thus, eight batches of resin coated foundry sand were prepared.

EXAMPLE 6

Example 4 was repeated with the difference that d-potassium hydrogentartrate was added in the amount of 0.6 g (0.5 part by weight), 3.6 g (3 parts by weight), 6.0 g (5 parts by weight), 12.0 g (10 parts by weight), 18.0 g (15 parts by weight), 24.0 g (20 parts by weight), 36.0 g (30 parts by weight), and 42.0 g (35 parts by weight), respectively, thus preparing eight batches of resin coated foundry sand.

COMPARATIVE EXAMPLE 4

A single procedure of Example 4 was repeated two times with the difference that the added amount of calcium hydroxide was varied to zero (none) and 8.0 g (40 parts by weight), respectively, thus preparing two batches of resin coated foundry sand.

COMPARATIVE EXAMPLE 5

A single procedure of Example 5 was repeated with the difference that the added amount of zinc carbonate was varied to 48.0 g (40 parts by weight), thus preparing a single batch of resin coated foundry sand.

COMPARATIVE EXAMPLE 6

A single procedure of Example 6 was repeated with the difference that the added amount of d-potassium hydrogentartrate was varied to 48.0 g (40 parts by weight), thus preparing a single batch of resin coated foundry sand.

EXAMPLE 7

A mixture (designation "PS-2178" of Gunei Chemical Industry Co., Ltd.) of commercially available novolak type phenolic resin (phenol-formaldehyde resin) and resol type phenolic resin (phenol-formaldehyde resin) was pulverized into powder. Subsequently, 6.0 Kg of silica sand (trade name "Nikko Keisa No. 6") preheated to 140° C. was charged into a rotating sand mixer, and immediately thereafter a mixture of 90.0 g of the phenolic resin mixture and 0.45 g of calcium hydroxide (corresponding to 0.5 part by weight to 100 parts by weight of the phenolic resin mixture) was charged into the mixer and stirred. At the time point the solidification of the resin mixture had begun and the sand had become into its blocking state, 4.5 g of calcium stearate was added to the content of the mixer, in which the sterring was continued until the content of the mixer had become in its dried state in appearance, thereby preparing a resin coated foundry sand.

The above-described procedure was repeated seven time with the difference that the amount of calcium hydroxide was varied to 2.7 g (3 parts by weight), 4.5 g (5 parts by weight), 9.0 g (10 parts by weight), 13.5 g (15 parts by weight), 18.0 g (20 parts by weight), 27.0 g (30 parts by weight), and 31.5 g (35 parts by weight), respectively. Thus, eight batches of resin coated sand were prepared.

EXAMPLE 8

Example 7 was repeated with the difference that zinc carbonate was added in the amount of 0.45 g (0.5 part by weight), 2.7 g (3 parts by weight), 4.5 g (5 parts by weight), 9.0 g (10 parts by weight), 13.5 g (15 parts by weight), 18.0 g (20 parts by weight), 27.0 g (30 parts by weight), and 31.5 g (35 parts by weight), respectively, to 90.0 g of the mixture of the novolak and resol types phenolic resins and 9.0 g of calcium hydroxide, thus preparing eight batches of resin coated foundry sand.

EXAMPLE 9

Example 7 was repeated with the difference that sulfanilic acid was added in the amount of 0.45 g (0.5 part by weight), 2.7 g (3 parts by weight), 4.5 g (5 parts by weight), 9.0 g (10 parts by weight), 13.5 g (15 parts by weight), 18.0 g (20 parts by weight), 27.0 g (30 parts by weight), and 31.5 g (35 parts by weight), respectively, to 90.0 g of the mixture of the novolak and resol types phenolic resins and 9.0 g of calcium hydroxide, thus preparing eight batches of resin coated foundry sand.

COMPARATIVE EXAMPLE 7

Example 7 was repeated two times with difference that the added amount of calcium hydroxide was varied to zero (none) and 36.0 g (40 parts by weight), respectively, thus preparing two batches of resin coated foundry sand.

COMPARATIVE EXAMPLE 8

A single procedure of Example 8 was repeated with the difference that the added amount of zinc carbonate was varied to 36.0 g (40 parts by weight), thereby preparing a single batch of resin coated foundry sand.

COMPARATIVE EXAMPLE 9

A single procedure of Example 9 was repeated with difference that the added amount of sulfanilic acid was varied to 36.0 g (40 parts by weight), thereby preparing a single batch of resin coated foundry sand.

EXAMPLE 10

120.0 g of furan resin (designation "Kao Litener KX-205" of Kao Quaker Co., Ltd.) and 48.0 g of peroxide (designation "Kao Litener P-70" of Kao Quaker Co., Ltd.) were weighed out, the furan resin being furfuryl alcohol resin, and the peroxide being methyl ethyl keton peroxide. 10.0 Kg of silica sand (trade name "Nikko Keisa No. 6") was charged into a rotating sand mixer, and then the weighed furan resin and peroxide were charged into the mixer in the order mentioned and mixed with sterring. Subsequently, 0.6 g of calcium hydroxide (0.5 part by weight to 100 parts by weight of resin) was charged into the mixer and stirred to be mixed.

The above-described procedure was repeated seven times with the difference that the amount of calcium hydroxide was varied to 3.6 g (3 parts by weight), 6.0 g (5 parts by weight), 12.0 g (20 parts by weight), 18.0 g (15 parts by weight), 24.0 g (20 parts by weight), 36.0 g (30 parts by weight), and 42.0 g (35 parts by weight), respectively. Thus, eight batches of resin coated foundry sand were prepared.

EXAMPLE 11

Example 10 was repeated with the difference that zinc carbonate was added in the amount of 0.6 g (0.5 part by weight), 3.6 g (3 parts by weight), 6.0 g (5 parts by weight), 12.0 g (10 parts by weight), 18.0 g (15 parts by weight), 24.0 g (20 parts by weiht), 36.0 g (30 parts by weight), and 42.0 g (35 parts by weight), respectively, to the system of 120.0 g of furan resin, 48.0 g of peroxide and 12.0 g of calcium hydroxide, thus preparing eight batches of resin coated sand.

EXAMPLE 12

Example 10 was repeated with the difference that azodicarbonamide was added in the amount of 1.6 g (0.5 part by weight), 3.6 g (3 parts by weight), 6.0 g (5 parts by weight), 12.0 g (10 parts by weight), 18.0 g (15 parts by weight), 24.0 g (20 parts by weight), 36.0 g (30 parts by weight), and 42.0 g (35 parts by weight), respectively, to the system of 120.0 g of furan resin, 48.0 g of peroxide, and 12.0 g of calcium hydroxide, thus preparing eight batches of resin coated foundry sand.

COMPARATIVE EXAMPLE 10

A single procedure of Example 10 was repeated two times with the difference that the added amount of calcium hydroxide was varied to zero (none) and 48.0 g (40 parts by weight), respectively, thus preparing two batches of resin coated foundry sand.

COMPARATIVE EXAMPLE 11

A single procedure of Example 11 was repeated with the difference that the added amount of zinc carbonate was varied to 48.0 g (40 parts by weight), thereby preparing a single batch of resin coated foundry sand.

COMPARATIVE EXAMPLE 12

A single procedure of Example 12 was repeated with the difference that the added amount of azodicarbonamide was varied to 48.0 g (40 parts by weight), thus preparing a single batch of resin coated foundry sand.

EXAMPLE 13

Commercially available novolak type phenolic resin (designation "SP-1640" of Gunei Chemical Industry Co., Ltd.) was pulverized into powder. Subsequently, 4.0 kg of silica sand (trade name "Nikko Keisa No. 6") preheated to 160° C. was charged into a rotating sand mixer, and immediately thereafter a mixture of 80.0 g of the powered novolak type phenolic resin and 0.4 g of calcium carbonate (corresponding to 0.5 part by weight to 100 parts by weight of the resin) was charged into the mixer and stirred. At the time point the temperature of the silica sand had reached 110° C., a 20 weight % concentration aqueous solution of 12 g of hexamethylenetetramine was added to the content of the mixer. At the time point the solidification of the resin had begun and the sand had become into its blocking state, 4.0 g of calcium stearate was charged into the mixer, in which sterring was continued until the content in the mixer is changed into its dried state in appearance, thereby preparing a resin coated sand. In this case, the temperature of the sand lowered below the softening temperature of the resin.

The above-described procedure was repeated seven times with the difference that the amount of calcium carbonate was varied to 2.4 g (3 parts by weight), 4.0 g (5 parts by weight), 8.0 g (10 parts by weight), 12.0 g (15 parts by weight), 16.0 g (20 parts by weight), 24.0 g (30 parts by weight), and 28.0 g (35 parts by weight), respectively, thus preparing eight batches of resin coated foundry sand.

EXAMPLE 14

Example 13 was repeated with difference that sodium hydrogencarbonate was added in the amount of 0.4 g (0.5 part by weight), 2.4 g (3 parts by weight), 4.0 g (5 parts by weight), 8.0 g (10 parts by weight), 12.0 g (15 parts by weight), 16.0 g (20 parts by weight), 24.0 g (30 parts by weight), and 28.0 g (35 parts by weight), respectively, into 80 g of the novolak type phenolic resin and 8.0 g of calcium carbonate, thus preparing eight batches of resin coated foundry sand.

EXAMPLE 15

Example 13 was repeated with the difference that azodicarbonamide was added in the amount of 0.4 g (0.5 part by weight), 2.4 g (3 parts by weight), 4.0 g (5 parts by weight), 8.0 g (10 parts by weight), 12.0 g (15 parts by weight), 16.0 g (20 parts by weight), 24.0 g (30 parts by weight), 28.0 g (35 parts by weight), respectively, to 80.0 g of novolak type phenolic resin and 8.0 g of calcium carbonate, thus preparing eight batches of resin coated foundry sand.

COMPARATIVE EXAMPLE 13

A single procedure of Example 13 was repeated two times with the difference that the added amount of calcium carbonate was varied to zero (none) and 32.0 g (40 parts by weight), respectively, thereby preparing two batches of resin coated foundry sand.

COMPARATIVE EXAMPLE 14

A single procedure of Example 14 was repeated with the difference that the added amount of sodium hydrogencarbonate was varied to 32 g (40 parts by weight), thereby preparing a single batch of resin coated foundry sand.

COMPARATIVE EXAMPLE 15

A single procedure of Example 15 was repeated with the difference that the added amount of azodicarbonamide was varied to 32.0 g (40 parts by weight), thus preparing a single batch of resin coated foundry sand.

EXAMPLE 16

Commercially available resol type phenolic resin (designation "PS-2176" of Gunei Chemical Industry Co., Ltd.) was pulverized into powder. Subsequently, 6.0 Kg of silica sand (trade name "Nikko Keisa No. 6") preheated to 140° C. was charged into a rotating sand mixer, and immediately thereafter a mixture of 120.0 g of the powdered resol type phenolic resin and 0.6 g of calcium carbonate (corresponding to 0.5 parts by weight to 100 parts by weight of the resin) was charged into the mixer and stirred. At the time point the solidification of the resin had begun and the sand had been become its blocking state, 6.0 g of calcium stearate was charged into the mixture, in which steering had been continued until the content of the mixer had changed into its dried state in appearance, thereby preparing a resin coated sand. In this case, the temperature of the sand lowered below the softening temperature of the resin at the time point of sterring termination.

The above-described procedure was repeated seven times with the difference that the amount of calcium carbonate was varied to 3.6 g (3 parts by weight), 6.0 g (5 parts by weight), 12.0 g (10 parts by weight), 18.0 g (15 parts by weight), 24.0 g (20 parts by weight), 36.0 g (30 parts by weight), and 42.0 g (35 parts by weight), respectively. Thus, eight batches of resin coated foundry sand were prepared.

EXAMPLE 17

Example 16 was repeated with the difference that zinc carbonate was added in the amount of 0.6 g (0.5 part by weight), 3.6 g (3 parts by weight), 6.0 g (5 parts by weight), 12.0 g (10 parts by weight), 18.0 g (15 parts by weight), 24.0 g (20 parts by weight), 36.0 g (30 parts by weight), and 42.0 g (35 parts by weight), respectively, to 120.0 g of resol type phenolic resin and 12.0 g of calcium carbonate, thus preparing eight batches of resin coated foundry sand.

EXAMPLE 18

Example 16 was repeated with the difference that d-potassium hydrogentartrate was added in the amount of 0.6 g (0.5 part by weight), 3.6 g (3 parts by weight), 6.0 g (5 parts by weight), 12.0 g (10 parts by weight), 18.0 g (15 parts by weight), 24.0 g (20 parts by weight), 36.0 g (30 parts by weight), and 42.0 g (35 parts by weight), respectively, to 120.0 g of the resol type phenolic resin and 12.0 g of calcium carbonate, thus preparing eight batches of resin coated foundry sand.

COMPARATIVE EXAMPLE 16

A single procedure of Example 16 was repeated two times with the difference that the added amount of calcium carbonate was varied to zero (none) and 48.0 g (40 parts by weight), respectively, thereby preparing two batches of resin coated foundry sand.

COMPARATIVE EXAMPLE 17

A single procedure of Example 17 was repeated with the difference that the added amount of zinc carbonate was varied to 48.0 g (40 parts by weight), thereby preparing a single batch of resin coated foundry sand.

COMPARATIVE EXAMPLE 18

A single procedure of Example 18 repeated with the difference that the added amount of potassium hydrogentartrate was varied to 48.0 g (40 parts by weight), thereby preparing a single batch of resin coated foundry sand.

EXAMPLE 19

A commercially available mixture (designation "PS-2178" of Gunei Chemical Industry Co., Ltd.) of novolak type phenolic resin and resol type phenolic resin was pulverized into powder. Subsequently, 6.0 Kg of silica sand (trade name "Nikko Keisa No. 6") was charged into a rotating sand mixer, and immediately thereafter a mixture of 90.0 g of the powdered phenolic resin mixture and 0.45 g of calcium carbonate (0.5 part by weight to 100 parts by weight of the resin mixture) was charged into the mixer and stirred. At the time point the solidification of the resin mixture had begun and the sand had become into its blocking state, 4.5 g of calcium stearate was charged into the mixer, in which sterring was continued until the content of the mixer had become in its dried state in appearance, thus preparing a resin coated foundry sand. In this case, the temperature of the sand lowered below the softening temperature of the resin mixture at the time point of sterring termination.

The above-described procedure was repeated seven times with the difference that the amount of calcium carbonate was varied to 2.7 g (3 parts by weight), 4.5 g (5 parts by weight), 9.0 g (10 parts by weight), 13.5 g (15 parts by weight), 18.0 g (20 parts by weight), 27.0 g (30 parts by weight), and 31.5 g (35 parts by weight), respectively. Thus, eight batches of resin coated sand were prepared.

EXAMPLE 20

Example 19 was repeated with the difference that zinc carbonate was added in the amount of 0.45 g (0.5 part by weight), 2.7 g (3 parts by weight), 4.5 g (5 parts by weight), 9.0 g (10 parts by weight), 13.5 g (15 parts by weight), 18.0 g (20 parts by weight), 27.0 g (30 parts by weight), and 31.5 g (35 parts by weight), respectively, to 90.0 g of the mixture of the novolak type and resol type phenolic resins and 9.0 g of zinc carbonate, thus preparing eight batches of resin coated foundry sand.

EXAMPLE 21

Example 19 was repeated with the difference that sulfanilic acid was added in the amount of 0.45 g (0.5 parts by weight), 2.7 g (3 parts by weight), 4.5 g (5 parts by weight), 9.0 g (10 parts by weight), 13.5 g (15 parts by weight), 18.0 g (20 parts by weight), 27.0 g (30 parts by weight), and 31.5 g (35 parts by weight), respectively, to 90.0 g of the mixture of novolak type and resol type phenolic resins and 9.0 g of calcium carbonate, thus preparing eight batches of resin coated foundry sand.

COMPARATIVE EXAMPLE 19

A single procedure was repeated two times with the difference that the added amount of calcium carbonate was varied to zero (none) and 36.0 g (40 parts by weight), thus preparing two batches of resin coated foundry sand.

COMPARATIVE EXAMPLE 20

A single procedure of Example 20 was repeated with the difference that the added amount of zinc carbonate was varied to 36.0 g (40 parts by weight), thereby preparing a single batch of resin coated foundry sand.

COMPARATIVE EXAMPLE 21

A single procedure of Example 21 was repeated with the difference that the added amount of sulfanilic acid was varied to 36.0 g (40 parts by weight), thus preparing a single batch of resin coated foundry sand.

EXAMPLE 22

120.0 g of commercially available furan resin (designation "Kao Litener KX-205" of Kao Quaker Co., Ltd.) and 48.0 g of peroxide (designation of "Kao Litener P-70" of Kao Quaker Co., Ltd.) were wighted out. 10.0 Kg of silica sand (trade name "Nikko Keisa No. 6") was charged into a rotating sand mixer, and then the weighed furan resin and peroxide were charged into the mixer in the order mentioned with sterring to be mixed with each other. Subsequently, 0.6 g of calcium carbonate (corresponding to 0.5 part by weight to 100 parts by weight of the resin) was charged into the mixer with sterring to be mixed with each other.

The above-described procedure was repeated seven times with the difference that the amount of calcium carbonate was varied to 3.6 g (3 parts by weight), 6.0 g (5 parts by weight), 12.0 g (10 parts by weight), 18.0 g (15 parts by weight), 24.0 g (20 parts by weight), 36.0 g (30 parts by weight), and 42.0 g (35 parts by weight), respectively. Thus, eight batches of resin coated foundry sand were prepared.

EXAMPLE 23

Example 22 was repeated with the difference that zinc carbonate was added in the amount of 0.6 g (0.5 part by weight), 3.6 g (3 parts by weight), 6.0 g (5 parts by weight), 12.0 g (10 parts by weight), 18.0 g (15 parts by weight), 24.0 g (20 parts by weight), 36.0 g (30 parts by weight), and 42.0 g (35 parts by weight), respectively, to the system of 120.0 g of the furan resin, 48.0 g of the peroxide, and 12.0 g of calcium carbonate, thus preparing eight batches of resin coated foundry sand.

EXAMPLE 24

Example 22 was repeated with the difference that azodicarbonamide was added in the amount of 1.6 g (0.5 part by weight), 3.6 g (3 parts by weight), 6.0 g (5 parts by weight), 12.0 g (10 parts by weight), 18.0 g (15 parts by weight), 24.0 g (20 parts by weiht), 36.0 g (30 parts by weight), and 42.0 g (35 parts by weight), respectively, to the system of 120.0 g of furan resin, 48.0 g of the peroxide, and 12.0 g calcium carbonate, thus preparing eight batches of resin coated foundry sand.

COMPARATIVE EXAMPLE 22

A single procedure of Example 22 was repeated two times with the difference that the added amount of calcium carbonate was varied to zero (none) and 48.0 g (40 parts by weight), respectively, thus preparing two batches of resin coated foundry sand.

COMPARATIVE EXAMPLE 23

A single procedure of Example 23 was repeated with the difference that the added amount of zinc carbonate was varied to 48.0 g (40 parts by weight), thereby preparing a single batch of resin coated foundry sand.

COMPARATIVE EXAMPLE 24

A single procedure of Example 24 was repeated with the difference that the added amount of azodicarbonamide was varied to 48.0 g (40 parts by weight), thereby preparing a single batch of resin coated foundry sand.

EXAMPLE 25

Commercially available novolak type phenolic resin (designation "SP-1640" of Gunei Chemical Industry Co., Ltd.) was pulverized into powder. Subsequently, 4.0 kg of silica sand (trade name "Nikko Keisa No. 6") preheated to 160° C. was charged into a rotating sand mixer, and immediately thereafter a mixture of 80.0 g of the powdered novolak type phenolic resin and 0.4 g of barium hydroxide (corresponding to 0.5 part by weight to 100 parts by weight of the resin) was charged into the mixer and stirred. At the time point the temperature of the silica sand had reached 110° C., a 20 weight % concentration aqueous solution of 12.0 g of hexamethylenetetramine was added to the content of the mixer. At the time point the solidification of the resin had begun and the sand had become into its blocking state, 4.0 g of calcium stearate was continued until the content of the mixer had become into its dried state in appearance, thereby preparing a resin coated foundry sand. In this case, the temperature of the sand lowered below the softening temperature of the resin.

The above-described procedure was repeated seven times with difference that the amount of barium hydroxide was varied to 2.4 g (3 parts by weight), 4.0 g (5 parts by weight), 8.0 g (10 parts by weight), 12.0 g (15 parts by weight), 16.0 g (20 parts by weight), 24.0 g (30 parts by weight), and 28.0 g (35 parts by weight), respectively. Thus, eight batches of resin coated foundry sand were prepared.

EXAMPLE 26

Example 25 was repeated with the difference that sodium hydrogencarbonate was added in the amount of 0.4 g (5 part by weight), 2.4 g (3 parts by weight), 4.0 g (5 parts by weight), 8.0 g (10 parts by weight), 12.0 g (15 parts by weight), 16.0 g (20 parts by weight), 24.0 g (30 parts by weight), and 28.0 g (35 parts by weight), respectively, to 80.0 g of the novolak type phenolic resin and 8.0 g of barium hydroxide, thus preparing eight batches of resin coated foundry sand.

EXAMPLE 27

Example 25 was repeated with the difference that azodicarbonamide was added in the amount of 0.4 g (0.5 parts by weight), 2.4 g (3 parts by weight), 4.0 g (5 part by weight), 8.0 g (10 parts by weight), 12.0 g (15 parts by weight), 16.0 g (20 parts by weight), 24.0 g (30 parts by weight), and 28.0 g (35 parts by weight), respectively, to 80.0 g of the novolak type phenolic resin and 8.0 g of barium oxide, thus preparing eight batches of resin coated foundry sand.

COMPARATIVE EXAMPLE 25

A single procedure of Example 25 was repeated two times with the difference that the added amount of barium hydroxide was varied to zero (none) and 32.0 g (40 parts by weight), respectively, thereby preparing two batches of resin coated foundry sand.

COMPARATIVE EXAMPLE 26

A single procedure of Example 26 was repeated with the difference that the added amount of sodium hydrogencarbonate was varied to 32.0 g (40 parts by weight), thereby preparing a single batch of resin coated foundry sand.

COMPARATIVE EXAMPLE 27

A single procedure of Example 27 was repeated with the difference that the added amount of azodicarbonamide was varied to 32.0 g (40 parts by weight), thus preparing a single batch of resin coated foundry sand.

EXAMPLE 28

Commercially available resol type phenolic resin (designation "PS-2176" of Gunei Chemical Industry Co., Ltd.) was pulverized into powder. Subsequently, 6.0 Kg of silica sand (trade name "Nikko Keisa No. 6") preheated to 140° C. was charged into a rotating sand mixer, and immediately thereafter a mixture of 120.0 g of the powdered resol type phenolic resin and 0.6 g of barium hydroxide (corresponding to 0.5 part by weight to 100 parts by weight of the resin) was charged into the mixer and stirred. At the time point the solidification of the resin had begun and the sand had become into its blocking state, 6.0 g of calcium stearate was charged into the mixer, in which stirring was continued until the content of the mixer becomes into its dried state in appearance, thereby preparing a resin coated foundry sand. In this case, the temperature of the sand lowered below the softening temperature of the resin in the time point of stirring termination.

The above-described procedure was repeated seven times with the difference that the amount of barium hydroxide was varied to 3.6 g (3 parts by weight), 6.0 g (5 parts by weight), 12.0 g (10 parts by weight), 18.0 g (15 parts by weight), 24.0 g (20 parts by weight), 36.0 g (30 parts by weight), and 42.0 g (35 parts by weight), respectively. Thus, eight batches of resin coated foundry sand were prepared.

EXAMPLE 29

Example 28 was repeated with the difference that zinc carbonate was added in the amount of 0.6 g (0.5 part by weight), 3.6 g (3 parts by weight), 6.0 g (5 parts by weight), 12.0 g (10 parts by weight), 18.0 g (15 parts by weight), 24.0 g (20 parts by weight), 36.0 g (30 parts by weight), and 42.0 g (35 parts by weight), respectively, to 120.0 g of the resol type phenolic resin and 12.0 g of barium hydroxide, thus preparing eight batches of resin coated foundry sand.

EXAMPLE 30

Example 28 was repeated with the difference that d-potassium hydrogentartrate was added in the amount of 0.6 g (0.5 part by weight), 3.6 g (3 parts by weight), 6.0 g (5 parts by weight), 12.0 g (10 parts by weight), 18.0 g (15 parts by weight), 24.0 g (20 parts by weight), 36.0 g (30 parts by weight), and 42.0 g (35 parts by weight), respectively, to 120.0 g of the resol type phenolic resin and 12.0 g of barium hydroxide, thus preparing eight batches of resin coated foundry sand.

COMPARATIVE EXAMPLE 28

A single procedure of Example 28 was repeated two times with the difference that the added amount of barium hydroxide was varied to zero (none) and 48.0 g (40 parts by weight), respectively, thereby preparing two batches of resin coated foundry sand.

COMPARATIVE EXAMPLE 29

A single procedure of Example 29 was repeated with the difference that the added amount of zinc carbonate was varied to 48.0 g (40 parts by weight), thereby preparing a single batch of resin coated foundry sand.

COMPARATIVE EXAMPLE 30

A single procedure of Example 30 was repeated with the difference that the added amount of d-potassium hydrogentartrate was varied to 48.0 g (40 parts by weight), thereby preparing a single batch of resin coated foundry sand.

EXAMPLE 31

A mixture (designation "PS-2178" of Gunei Chemical Industry Co., Ltd.) of novolak type phenolic resin and resol type phenolic resin was pulverized into powder. Subsequently, 6.0 Kg of silica sand (trade name "Nikko Keisa No. 6") preheated to 140° C. was charged into a rotating sand mixer, and immediately thereafter a mixture of 90.0 g of the powdered mixture of the phenolic resins and 0.45 g of barium hydroxide (0.5 part by weight to 100 parts by weight of the resin mixture) was charged into the mixer and stirred. At the time point the solidification of the resin mixture had begun and the sand had become into its blocking state, 4.5 g of calcium stearate was charged into the mixer, in which sterring was continued until the content of the mixer had become into its dried state, thereby preparing a resin coated foundry sand. In this case, the temperature of the sand lowered below the softening temperature of the resin mixture.

The above-described procedure was repeated seven times with the difference that the amount of barium hydroxide was varied to 2.7 g (3 parts by weight), 4.5 g (5 parts by weight), 9.0 g (10 parts by weight), 13.5 g (15 parts by weight), 18.0 g (20 parts by weight), 27.0 g (30 parts by weight), and 31.5 g (35 parts by weight), respectively. Thus, eight batches of resin coated foundry sand were prepared.

EXAMPLE 32

Example 31 was repeated with the difference that zinc carbonate was added in the amount of 0.45 g (0.5 part by weight), 2.7 g (3 parts by weight), 4.5 g (5 parts by weight), 9.0 g (10 parts by weight), 13.5 g (15 parts by weight), 18.0 g (20 parts by weigth), 27.0 g (30 parts by weight), and 31.5 g (35 parts by weight), respectively, to 90.0 g of the mixture of the novolak type and resol type phenolic resins and 9.0 g of barium hydroxide, thus preparing eight batches of resin coated foundry sand.

EXAMPLE 33

Example 31 was repeated with the difference that sulfanilic acid was added in the amount of 0.45 g (0.5 part by weight), 2.7 g (3 parts by weight), 4.5 g (5 parts by weight), 9.0 g (10 parts by weight), 13.5 g (15 parts by weight), 18.0 g (20 parts by weight), 27.0 g (30 parts by weight), and 31.5 g (35 parts by weight), to 90.0 g of the mixture of the novolak type and resol type phenolic resins and 9.0 g of barium hydroxide, thus preparing eight batches of resin coated foundry sand.

COMPARATIVE EXAMPLE 31

A single procedure of Example 31 was repeated two times with the difference that the added amount of barium hydroxide was varied to zero (none) and 36.0 g (40 parts by weight), respectively, thereby preparing two batches of resin coated foundry sand.

COMPARATIVE EXAMPLE 32

A single procedure of Example 32 was repeated with the difference that the added amount of zinc carbonate was varied to 36.0 g (40 parts by weight), thereby preparing a single batch of resin coated foundry sand.

COMPARATIVE EXAMPLE 33

A single procedure of Example 33 was repeated with the difference that the added amount of sulfanilic acid was varied to 36.0 g (40 parts by weight), thereby preparing a single batch of resin coated foundary sand.

EXAMPLE 34

120.0 g of commercially available furan resin (designation "Kao Litener KX-205" of Kao Quaker Co., Ltd.) and 48.0 g of peroxide (designation "Kao Litener P-70" of Kao Quaker Co., Ltd.) were weighted out. 10.0 Kg of silica sand (trade name "Nikko Keisa No. 6") was charged into a rotating sand mixer, and then the weighed furan resin and peroxide were charged into the mixer in the order mentioned with steering to be mixed with each other. Subsequently, 0.6 g of barium hydroxide (corresponding to 0.5 part by weight to 100 parts by weight of the resin) was charged into the mixer with sterring to be mixed with each other.

The above-described procedure was repeated seven times with the difference that the amount of barium hydroxide was varied to 3.6 g (3 parts by weight), 6.0 g (5 parts by weight), 12.0 g (10 parts by weight), 18.0 g (15 parts by weight), 24.0 g (20 parts by weight), 36.0 g (30 parts by weight), and 42.0 g (35 parts by weight), respectively. Thus, eight batches of resin coated foundry sand were prepared.

EXAMPLE 35

Example 34 was repeated with the difference that zinc carbonate was added in the amount of 0.6 g (0.5 part by weight), 3.6 g (3 parts by weight), 6.0 g (5 parts by weight), 12.0 g (10 parts by weight), 18.0 g (15 parts by weight), 24.0 g (20 parts by weight), 36.0 g (30 parts by weight), and 42.0 g (35 parts by weight), respectively, to the system of 120.0 g of the furan resin, 48.0 g of the peroxide, and 12.0 g of barium hydroxide, thus preparing eight batches of resin coated foundry sand.

EXAMPLE 36

Example 34 was repeated with difference that azodicarbonamide was added in the amount of 1.6 g (0.5 part by weight), 3.6 g (3 parts by weight), 6.0 g (5 parts by weight), 12.0 g (10 parts by weight), 18.0 g (15 parts by weight), 24.0 g (20 parts by weight), 36.0 g (30 parts by weight), and 42.0 g (35 parts by weight), respectively, to the system of 120.0 g of the furan resin, 48.0 g of the peroxide, and 12.0 g of barium hydroxide, thus preparing eight batches of resin coated foundry sand.

COMPARATIVE EXAMPLE 34

A single procedure of Example 34 was repeated two times with the difference that the added amount of barium hydroxide was varied to zero (none) and 48.0 g (40 parts by weight), respectively, thus preparing two batches of resin coated foundry sand.

COMPARATIVE EXAMPLE 35

A single procedure of Example 35 was repeated with the difference that the added amount of zinc carbonate was varied to 48.0 g (40 parts by weight), thereby preparing a single batch of resin coated foundry sand.

COMPARATIVE EXAMPLE 36

A single procedure of Example 36 was repeated with the difference that the added amount of azodicarbonamide was varied to 48.0 g (40 parts by weight), thereby preparing a single batch of resin coated foundry sand.

EXAMPLE 37

Commercially available novolak type phenolic resin (designation "SP-1640" of Gunei Chemical Industry Co., Ltd.) was pulverized into powder. Subsequently, 4.0 kg of silica sand (trade name "Nikko Keisa No. 6") preheated to 160° C. was charged into a rotating sand mixer, and immediately thereafter a mixture of 80.0 g of the powdered novolak type phenolic resin and 0.4 g of barium carbonate (corresponding to 0.5 part by weight to 100 parts by weight of the resin) was charged into the mixer and stirred. At the time point the temperature of the silica sand had reached 110° C., a 20 weight % concentration aqueous solution of 12.0 g of hexamethylenetetramine was added to the content of the mixer. At the time point the solidification of the resin had begun and the sand had become into its blocking state, 4.0 g of calcium stearate was charged into the mixer, in which stirring was continued until the content of the mixer had become into its dried state in appearance, thereby preparing a resin coated foundry sand. In this case, the temperature of the sand lowered below the softening temperature of the resin.

The above-described procedure was repeated seven times with difference that the amount of barium carbonate was varied to 2.4 g (3 parts by weight), 4.0 g (5 parts by weight), 8.0 g (10 parts by weight), 2.0 g (15 parts by weight), 16.0 g (20 parts by weight), 24.0 g (30 parts by weight), and 28.0 g (35 parts by weight), respectively. Thus, eight batches of resin coated sand were prepared.

EXAMPLE 38

Example 37 was repeated with the difference that sodium hydrogencarbonate was added in the amount of 0.4 g (5 part by weight), 2.4 g (3 parts by weight), 4.0 g (5 parts by weight), 8.0 g (10 parts by weight), 12.0 g (15 parts by weight), 16.0 g (20 parts by weight), 24.0 g (30 parts by weight), and 28.0 g (35 parts by weight), respectively, to 80.0 g of the novolak type phenolic resin and 8.0 g of barium carbonate, thus preparing eight batches of resin coated foundry sand.

EXAMPLE 39

Example 37 was repeated with the difference that azodicarbonamide was added in the amount of 0.4 g (0.5 part by weight), 2.4 g (3 parts by weight), 4.0 g (5 parts by weight), 8.0 g (10 parts by weight), 12.0 g (15 parts by weight), 16.0 g (20 parts by weight), 24.0 g (30 parts by weight), and 28.0 g (35 parts by weight), respectively, to 80.0 g of the novolak type phenolic resin and 8.0 g of barium carbonate, thus preparing eight batches of resin coated foundry sand.

COMPARATIVE EXAMPLE 37

A single procedure of Example 37 was repeated two times with the difference that the added amount of barium carbonate was varied to zero (none) and 32.0 g (40 parts by weight), respectively, thereby preparing two batches of resin coated foundry sand.

COMPARATIVE EXAMPLE 38

A single procedure of Example 38 was repeated with the difference that the added amount of sodium hydrogencarbonate was varied to 32.0 g (40 parts by weight), thereby preparing a single batch of resin coated foundry sand.

COMPARATIVE EXAMPLE 39

A single procedure of Example 39 was repeated with the difference that the added amount of azodicarbonamide was varied to 32.0 g (40 parts by weight), thus preparing a single batch of resin coated foundry sand.

EXAMPLE 40

Commercially available resol type phenolic resin (designation "PS-2176" of Gunei Chemical Industry Co., Ltd.) was pulverized into powder. Subsequently, 6.0 Kg of silica sand (trade name "Nikko Keisa No. 6") preheated to 140° C. was charged into a rotating sand mixer, and immediately thereafter a mixture of 120.0 g of the powdered resol type phenolic resin and 0.6 g of barium carbonate (corresponding to 0.5 part by weight to 100 parts by weight of the resin) was charged into the mixer and stirred. At the time point the solidification of the resin had begun and the sand had become into its blocking state, 6.0 g of calcium stearate was charged into the mixer, in which stirring was continued until the content of the mixer became into its dried state in appearance, thereby preparing a resin coated foundry sand. In this case, the temperature of the sand lowered below the softening temperature of the resin in the time point of sterring termination.

The above-described procedure was repeated seven times with the difference that the amount of barium carbonate was varied to 3.6 g (3 parts by weight), 6.0 g (5 parts by weight), 12.0 g (10 parts by weight), 18.0 g (15 parts by weight), 24.0 g (20 parts by weight), 36.0 g (30 parts by weight), and 42.0 g (35 parts by weight), respectively. Thus, eight batches of resin coated foundry sand were prepared.

EXAMPLE 41

Example 40 was repeated with the difference that zinc carbonate was added in the amount of 0.6 g (0.5 parts by weight), 3.6 g (3 parts by weight), 6.0 g (5 parts by weight), 12.0 g (10 parts by weight), 18.0 g (15 parts by weight), 24.0 g (20 parts by weight), 36.0 g (30 parts by weight), and 42.0 g (35 parts by weight), respectively, to 120.0 g of the resol type phenolic resin and 12.0 g of barium carbonate, thus preparing eight batches of resin coated foundry sand.

EXAMPLE 42

Example 40 was repeated with the difference that d-potassium hydrogentartrate was added in the amount of 0.6 g (0.5 part by weight), 3.6 g (3 parts by weight), 6.0 g (5 parts by weight), 12.0 g (10 parts by weight), 18.0 g (15 parts by weight), 24.0 g (20 parts by weight), 36.0 g (30 parts by weight), and 42.0 g (35 parts by weight), respectively, to 120.0 g of the resol type phenolic resin and 12.0 g of barium carbonate, thus preparing eight batches of resin coated foundry sand.

COMPARATIVE EXAMPLE 40

A single procedure of Example 40 was repeated two times with the difference that the added amount of barium carbonate was varied to zero (none) and 48.0 g (40 parts by weight), respectively, thereby preparing two batches of resin coated foundry sand.

COMPARATIVE EXAMPLE 41

A single procedure of Example 41 was repeated with the difference that the added amount of zinc carbonate was varied to 48.0 g (40 parts by weight), thereby preparing a single batch of resin coated foundry sand.

COMPARATIVE EXAMPLE 42

A single procedure of Example 42 was repeated with the difference that the added amount of d-potassium hydrogentartrate was varied to 48.0 g (40 parts by weight), thereby preparing a single batch of resin coated foundry sand.

EXAMPLE 43

A commercially available mixture (designation "PS-2178" of Gunei Chemical Industry Co., Ltd.) of novolak type phenolic resin and resol type phenolic resin was pulverized into powder. Subsequently, 6 Kg of silica sand (trade name "Nikko Keisa No. 6") preheated to 140° C. was charged into a rotating sand mixer, and thereafter a mixture of 90.0 g of the powdered mixture of the phenolic resins and 0.45 g of barium carbonate (0.5 parts by weight to 100 parts by weight of the resin mixture) was charged into the mixer and stirred. At the time point the solidification of the resin mixture had begun and the sand had become into its blocking state, 4.5 g of calcium stearate was charged into the mixer, in which sterring was continued until the content of the mixer has become into its dried state, thereby preparing a resin coated foundry sand. In this case, the temperature of the sand lowered below the softening temperature of the resin mixture.

The above-described procedure was repeated seven times with the difference that the amount of barium carbonate was varied to 2.7 g (3 parts by weight), 4.5 g (5 parts by weight), 9.0 g (10 parts by weight), 13.5 g (15 parts by weight), 18.0 g (20 parts by weight), 27.0 g (30 parts by weight), and 31.5 g (35 parts by weight), respectively. Thus, eight batches of resin coated foundry sand were prepared.

EXAMPLE 44

Example 43 was repeated with the difference that zinc carbonate was added in the amount of 0.45 g (0.5 part by weight), 2.7 g (3 parts by weight), 4.5 g (5 parts by weight), 9.0 g (10 parts by weight), 13.5 g (15 parts by weight), 18.0 g (20 parts by weight), 27.0 g (30 parts by weight), and 31.5 g (35 parts by weight), respectively, to 90.0 g of the mixture of the novolak type and resol type phenolic resins and 9.0 g of barium carbonate, thus preparing eight batches of resin coated foundry sand.

EXAMPLE 45

Example 43 was repeated with the difference that sulfanilic acid was added in the amount of 0.45 g (0.5 part by weight), 2.7 g (3 parts by weight), 4.5 g (5 parts by weight), 9.0 g (10 parts by weight), 13.5 g (15 parts by weight), 18.0 g (20 parts by weight), 27.0 g (30 parts by weight), and 31.5 g (35 parts by weight), to 90.0 g of the mixture of the novolak type and resol type phenolic resins and 9.0 g of barium carbonate, thus preparing eight batches of resin coated foundry sand.

COMPARATIVE EXAMPLE 43

A single procedure of Example 43 was repeated two times with the difference that the added amount of barium carbonate was varied to zero (none) and 36.0 g (40 parts by weight), respectively, thereby preparing two batches of resin coated foundry sand.

COMPARATIVE EXAMPLE 44

A single procedure of Example 44 was repeated with the difference that the added amount of zinc carbonate was varied to 36.0 g (40 parts by weight), thereby preparing a single batch of resin coated foundry sand.

COMPARATIVE EXAMPLE 45

A single procedure of Example 45 was repeated with the difference that the added amount of sulfanilic acid was varied to 36.0 g (40 parts by weight), thereby preparing a single batch of resin coated foundry sand.

EXAMPLE 46

120.0 g of commercially available furan resin (designation "Kao Litener KX-205" of Kao Quaker Co., Ltd.) and 48.0 g of peroxide (designation of "Kao Litener P-70" of Kao Quaker Co., Ltd.) were weighted out. 10 Kg of silica sand (trade name "Nikko Keisa No. 6") was charged into a rotating sand mixer, and then the weighed furan resin and peroxide were charged into the mixer in the order mentioned with sterring to be mixed with each other. Subsequently, 0.6 g of barium carbonate (corresponding to 0.5 parts by weight to 100 parts by weight of the resin) was charged into the mixer with sterring to be mixed with each other.

The above-described procedure was repeated seven times with the difference that the amount of barium carbonate was varied to 3.6 g (3 parts by weight), 6.0 g (5 parts by weight), 12.0 g (10 parts by weight), 18.0 g (15 parts by weight), 24.0 g (20 parts by weight), 36.0 g (30 parts by weight), and 42.0 g (35 parts by weight), respectively. Thus, eight batches of resin coated foundry sand were prepared.

EXAMPLE 47

Example 46 was repeated with the difference that zinc carbonate was added in the amount of 0.6 g (0.5 part by weight), 3.6 g (3 parts by weight), 6.0 g (5 parts by weight), 12.0 g (10 parts by weight), 18.0 g (15 parts by weight), 24.0 g (20 parts by weight), 36.0 g (30 parts by weight), and 42.0 g (35 parts by weight), respectively, to the system of 120.0 g of the furan resin, 48.0 g of the peroxide, and 12.0 g of barium carbonate, thus preparing eight batches of resin coated foundry sand.

EXAMPLE 48

Example 46 was repeated with the difference that azodicarbonamide was added in the amount of 0.6 g (0.5 part by weight), 3.6 g (3 parts by weight), 6.0 g (5 parts by weight), 12.0 g (10 parts by weight), 18.0 g (15 parts by weight), 24.0 g (20 parts by weight), 36.0 g (30 parts by weight), and 42.0 g (35 parts by weight), respectively, to the system of 120.0 g of the furan resin, 48.0 g of the peroxide, and 12.0 g of barium carbonate, thus preparing eight batches of resin coated foundry sand.

COMPARATIVE EXAMPLE 46

A single procedure of Example 46 was repeated two times with the difference that the added amount of barium carbonate was varied to zero (none) and 48.0 g (40 parts by weight), respectively, thus preparing two batches of resin coated foundry sand.

COMPARATIVE EXAMPLE 47

A single procedure of Example 47 was repeated with the difference that the added amount of zinc carbonate was varied to 48.0 g (40 parts by weight), thereby preparing a single batch of resin coated foundry sand.

COMPARATIVE EXAMPLE 48

A single procedure of Example 48 was repeated with the difference that the added amount of azodicarbonamide was varied to 48.0 g (40 parts by weight), thereby preparing a single batch of resin coated foundry sand.

EXAMPLE 49

A commercially available mixture (designation "PS-2178" of Gunei Chemical Industry Co., Ltd.) of novolak type phenolic resin and resol type phenolic resin was pulverized into powder. Subsequently, 6.0 Kg of silica sand (trade name "Nikko Keisa No. 6") preheated to 140° C. was charged into a rotating sand mixer, and thereafter a mixture of 90.0 g of the powdered mixture of the phenolic resins and 0.45 g (0.5 part by weight to 100 parts by weight of the resin mixture) of a mixture (1:1 in weight ratio) of calcium hydroxide and calcium carbonate was charged into the mixer and stirred. At the time point the solidification of the resin mixture had begun and the sand had become into its blocking state, 4.5 g of calcium stearate was charged into the mixer, in which sterring was continued until the content of the mixer had become into its dried state, thereby preparing a resin coated foundry sand. In this case, the temperature of the sand lowered below the softening temperature of the resin mixture.

The above-described procedure was repeated seven times with the difference that the amount of the mixture of calcium hydroxide and calcium carbonate was varied to 2.7 g (3 parts by weight), 4.5 g (5 parts by weight), 9.0 g (10 parts by weight), 3.5 g (15 parts by weight), 18.0 g (20 parts by weight), 27.0 g (30 parts by weight), and 31.5 g (35 parts by weight), respectively. Thus, eight batches of resin coated foundry sand were prepared.

EXAMPLE 50

Example 49 was repeated with the difference that zinc carbonate was added in the amount of 0.45 g (0.5 part by weight), 2.7 g (3 parts by weight), 4.5 g (5 parts by weight), 9.0 g (10 parts by weight), 13.5 g (15 parts by weight), 18.0 g (20 parts by weight), 27.0 g (30 parts by weight), and 31.5 g (35 parts by weight), respectively, to 90.0 g of the mixture of the novolak type and resol type phenolic resins and 9.0 g of the mixture of calcium hydroxide and calcium carbonate, thus preparing eight batches of resin coated foundry sand.

COMPARATIVE EXAMPLE 49

A single procedure of Example 49 was repeated two times with the difference that the added amount of the mixture of calcium hydroxide and calcium carbonate was varied to zero (none) and 36.0 g (40 parts by weight), respectively, thereby preparing two batches of resin coated foundry sand.

COMPARATIVE EXAMPLE 50

A single procedure of Example 50 was repeated with the difference that the added amount of zinc carbonate was varied to 36.0 g (40 parts by weight), thereby preparing a single batch of resin coated foundry sand.

EXAMPLE 51

A commercially available mixture (designation "PS-2178" of Gunei Chemical Industry Co., Ltd.) of novolak type phenolic resin and resol type phenolic resin was pulverized into powder. Subsequently, 6.0 Kg of silica sand (trade name "Nikko Keisa No. 6") preheated to 140° C. was charged into a rotating sand mixer, and thereafter a mixture of 90.0 g of the powdered mixture of the phenolic resins and 0.45 g (0.5 parts by weight to 100 parts by weight of the resin mixture) of a mixture (1:1 in weight ratio) of calcium hydroxide and barium hydroxide was charged into the mixer and stirred. At the time point the solidification of the resin mixture had begun and the sand had become into its blocking state, 4.5 g of calcium stearate was charged into the mixer, in which sterring was continued until the content of the mixer had become into its dried state, thereby preparing a resin coated foundry sand. In this case, the temperature of the sand lowered below the softening temperature of the resin mixture.

The above-described procedure was repeated seven times with the difference that the amount of the mixture of calcium hydroxide and barium hydroxide was varied to 2.7 g (3 parts by weight), 4.5 g (5 parts by weight), 9.0 g (10 parts by weight), 13.5 g (15 parts by weight), 18.0 g (20 parts by weight), 27.0 g (30 parts by weight), and 31.5 g (35 parts by weight), respectively. Thus, eight batches of resin coated foundry sand were prepared.

EXAMPLE 52

Example 51 was repeated with the difference that zinc carbonate was added in the amount of 0.45 g (0.5 part by weight), 2.7 g (3 parts by weight), 4.5 g (5 parts by weight), 9.0 g (10 parts by weight), 13.5 g (15 parts by weight), 18.0 g (20 parts by weight), 27.0 g (30 parts by weight), and 31.5 g (35 parts by weight), respectively, to 90.0 g of the mixture of the novolak type and resol type phenolic resins and 9.0 g of the mixture of calcium hydroxide and barium hydroxide, thus preparing eight batches of resin coated foundry sand.

COMPARATIVE EXAMPLE 51

A single procedure of Example 51 was repeated two times with the difference that the added amount of the mixture of calcium hydroxide and barium hydroxide was varied to zero (none) and 36.0 g (40 parts by weight), respectively, thereby preparing two batches of resin coated foundry sand.

COMPARATIVE EXAMPLE 52

A single procedure of Example 52 was repeated with the difference that the added amount of zinc carbonate was varied to 36.0 g (40 parts by weight), thereby preparing a single batch of resin coated foundry sand.

EXAMPLE 53

A commercially available mixture (designation "PS-2178" of Gunei Chemical Industry Co., Ltd.) of novolak type phenolic resin and resol type phenolic resin was pulverized into powder. Subsequently, 6.0 Kg of silica sand (trade name "Nikko Keisa No. 6") preheated to 140° C. was charged into a rotating sand mixer, and immediately thereafter a mixture of 90.0 g of the powdered mixture of the phenolic resins and 0.45 g (0.5 parts by weight to 100 parts by weight of the resin mixture) of a mixture (1:1 in weight ratio) of calcium hydroxide and barium carbonate was charged into the mixer and stirred. At the time point the solidification of the resin mixture had begun and the sand had become into its blocking state, 4.5 g of calcium stearate was charged into the mixer, in which sterring was continued until the content of the mixer had become into its dried state, thereby preparing a resin coated foundry sand. In this case, the temperature of the sand lowered below the softening temperature of the resin mixture.

The above-described procedure was repeated seven times with the difference that the amount of calcium hydroxide and barium carbonate was varied to 2.7 g (3 parts by weight), 4.5 g (5 parts by weight), 9.0 g (10 parts by weight), 13.5 g (15 parts by weight), 18.0 g (20 parts by weight), 27.0 g (30 parts by weight), and 31.5 g (35 parts by weight), respectively. Thus, eight batches of resin coated foundry sand were prepared.

EXAMPLE 54

Example 53 was repeated with the difference that zinc carbonate was added in the amount of 0.45 g (0.5 part by weight) 2.7 g (3 parts by weight), 4.5 g (5 parts by weight), 9.0 g (10 parts by weight), 13.5 g (15 parts by weight), 18.0 g (20 parts by weight), 27.0 g (30 parts by weight), and 31.5 g (35 parts by weight), respectively, to 90.0 g of the mixture of the novolak type and resol type phenolic resins and 9.0 g of the mixture of calcium hydroxide and barium carbonate, thus preparing eight batches of resin coated foundry sand.

COMPARATIVE EXAMPLE 53

A single procedure of Example 53 was repeated two times with the difference that the added amount of the mixture of calcium hydroxide and barium carbonate was varied to zero (none) and 36.0 g (40 parts by weight), respectively, thereby preparing two batches of resin coated foundry sand.

COMPARATIVE EXAMPLE 54

A single procedure of Example 54 was repeated with the difference that the added amount of zinc carbonate was varied to 36.0 g (40 parts by weight), thereby preparing a single batch of resin coated foundry sand.

EXAMPLE 55

A commercially available mixture (designation "PS-2178" of Gunei Chemical Industry Co., Ltd.) of novolak type phenolic resin and resol type phenolic resin was pulverized into powder. Subsequently, 6.0 Kg of silica sand (trade name "Nikko Keisa NO. 6") preheated to 140° C. was charged into a rotating sand mixer, and immediately thereafter a mixture of 90 g of the powdered mixture of the phenolic resins and 0.45 g (0.5 parts by weight to 100 parts by weight of the resin mixture) of a mixture (1:1 in weight ratio) of calcium carbonate and barium hydroxide was charged into the mixer and stirred. At the time point the solidification of the resin mixture had begun and the sand had become into its blocking state, 4.5 g of calcium stearate was charged into the mixer, in which sterring was continued until the content of the mixer had become into its dried state, thus preparing a resin coated foundry sand. In this case, the temperature of the sand lowered below the softening temperature of the resin mixture.

The above-described procedure was repeated seven times with the difference that the amount of the mixture of calcium carbonate and barium hydroxide was varied to 2.7 g (3 parts by weight), 4.5 g (5 parts by weight), 9.0 g (10 parts by weight), 13.5 g (15 parts by weight), 18.0 g (20 parts by weight), 27.0 g (30 parts by weight), and 31.5 g (35 parts by weight), respectively. Thus, eight batches of resin coated foundry sand were prepared.

EXAMPLE 56

Example 55 was repeated with the difference that zinc carbonate was added in the amount of 0.45 g (0.5 part by weight), 2.7 g (3 parts by weight), 4.5 g (5 parts by weight), 9.0 g (10 parts by weight), 13.5 g (15 parts by weight), 18.0 g (20 parts by weight), 27.0 g (30 parts by weight), and 31.5 g (35 parts by weight), respectively, to 90.0 g of the mixture of the novolak type and resol type phenolic resins and 9.0 g of the mixture of calcium carbonate and barium hydroxide, thus preparing eight batches of resin coated foundry sand.

COMPARATIVE EXAMPLE 55

A single procedure of Example 55 was repeated two times with the difference that the added amount of the mixture of calcium carbonate and barium hydroxide was varied to zero (none) and 36.0 g (40 parts by weight), respectively, thereby preparing two batches of resin coated foundry sand.

COMPARATIVE EXAMPLE 56

A single procedure of Example 56 was repeated with the difference that the added amount of zinc carbonate was varied to 36.0 g (40 parts by weight), thereby preparing a single batch of resin coated foundry sand.

EXAMPLE 57

A commercially available mixture (designation "PS-2178" of Gunei Chemical Industry Co., Ltd.) of novolak type phenolic resin and resol type phenolic resin was pulverized into powder. Subsequently, 6.0 Kg of silica sand (trade name "Nikko Keisa No. 6") preheated to 140° C. was charged into a rotating sand mixer, and immediately thereafter a mixture of 90.0 g of the powdered mixture of the phenolic resins and 0.45 g (0.5 parts by weight to 100 parts by weight of the resin mixture) of a mixture (1:1 in weight ratio) of calcium carbonate and barium carbonate was charged into the mixer and stirred. At the time point the solidification of the resin mixture had begun and the sand had become into its blocking state, 4.5 g of calcium stearate was charged into the mixer, in which sterring was continued until the content of the mixer has become into its dried state, thus preparing a resin coated foundry sand. In this case, the temperature of the sand lowered below the softening temperature of the resin mixture.

The above-described procedure was repeated seven times with the difference that the amount of the mixture of calcium carbonate and barium carbonate was varied to 2.7 g (3 parts by weight), 4.5 g (5 parts by weight), 9.0 g (10 parts by weight), 13.5 g (15 parts by weight), 18.0 g (20 parts by weight), 27.0 g (30 parts by weight), and 31.5 g (35 parts by weight), respectively. Thus, eight batches of resin coated foundry sand were prepared.

EXAMPLE 58

Example 57 was repeated with the difference that zinc carbonate was added in the amount of 0.45 g (0.5 part by weight), 2.7 g (3 parts by weight), 4.5 g (5 parts by weight), 9.0 g (10 parts by weight), 13.5 g (15 parts by weight), 18.0 g (20 parts by weight), 27.0 g (30 parts by weight), and 31.5 g (35 parts by weight), respectively, to 90.0 g of the mixture of the novolak type and resol type phenolic resins and 9.0 g of the mixture of calcium carbonate and barium carbonate, thus preparing eight batches of resin coated foundry sand.

COMPARATIVE EXAMPLE 57

A single procedure of Example 57 was repeated two times with the difference that the added amount of the mixture of calcium carbonate and barium carbonate was varied to zero (none) and 36.0 g (40 parts by weight), respectively, thereby preparing two batches of resin coated foundry sand.

COMPARATIVE EXAMPLE 58

A single procedure of Example 58 was repeated with the difference that the added amount of zinc carbonate was varied to 36.0 g (40 parts by weight), thereby preparing a single batch of resin coated foundry sand.

EXPERIMENT 1

Immediately after the completion of preparation of a variety of batches of the resin coated foundry sand in accordance with the Examples 1 to 9, 13 to 21, 25 to 33, 37 to 45, and 49 to 58, the Comparative Examples 1 to 9, 13 to 21, 25 to 33, 37 to 45, and 49 to 58, each batch of resin coated foundry sand was fired at 230° C. for 70 seconds to obtain a specimen (test piece). Hot tensile strength measurement test was made to the specimen by using a hot shell tensile tester at the above-mentioned firing temperature (230° C.). The result of the hot tensile strength measurment is shown at the column of "Strength" in Table 1.

EXPERIMENT 2

Each of a variety batches of resin coated foundry sand prepared in accordance with the Examples 1 to 9, 13 to 21, 25 to 33, 37 to 45, and 49 to 58, the Comparative Examples 1 to 9, 13 to 21, 25 to 33, 37 to 45, and 49 to 58 was poured into a metal pattern heated to 200° C. or higher and maintained at 250° C. for 5 minutes as it was in the metal pattern thereby to produce a specimen (test piece) having the dimensions of 50 mm length, 50 mm width and 20 mm thickness. The specimen was wrapped in an aluminum foil having the dimensions of 170 mm length and 125 mm width, and put in a furance to be heated at 500° C. After lapse of 21.5 minutes, the specimen was taken out from the furance to be cooled. The heating condition of this heat treatment in the furance corresponds to that in which the worst disintegration characteristics of molds and cores is encountered usually in case the molds and cores are actually prepared from resin coated foundry sand.

Sand drop amount measurement test was made to the specimen subjected to the heat treatment, by using a Ro-Tap type sieving apparatus which is usually used to particle size measurement test according to JIS (Japanese Industrial Standard) Z2602 and is equipped with only a 4-mesh sieve. More specifically, the specimen was put on the seive under which a receive container was placed, and then the seiving operation of the seiving apparatus was made for 1 minute to vibrate the seive, so that sand grains produced due to the disintegration of the specimen were dropped to the receiver container passing through the seive. The amount of the sand grains dropped to the receiver container was recorded as a sand drop amount. As a result, the disintegration rate of the specimen was represented as an weight percent of the sand drop amount to the weight of the specimen before being subjected to vibration. The thus obtained disintegration rate is shown at the column of "Disintegration rate" in Table 1.

EXPERIMENT 3

Immediately after the completion of preparation of a variety batches of resin coated foundry sand in accordance with the Examples 10 to 12, 22 to 24, 34 to 36, and 46 to 48, the Comparative Examples 10 to 12, 22 to 24, 34 to 36, and 46 to 48, each batch of the resin coated foundry sand was subjected to gassing of $SO_2$ be solidified, thereby to obtaining a specimen. The gassing was carried out as follows: $SO_2$ was introduced into a vaporizer under pressure of hydrogen thereby to be vaporized, in which the vaporizer and an intermediate accumulator tank were heated to 43° C. to regulate the pressure of $SO_2$ gas to 1.8 to 3.2 Kg/cm$^2$. The gassing time was selected from a range from 0.1 to 2 seconds depending on the size of the specimen. Thereafter, gas purging was taken place for 3 to 15 seconds by air under a pressure selected from a range from 2.1 to 4.2 Kg/cm$^2$ depending upon the size of the specimen, maintaining the temperature of the specimen at a temperature range of from 150 to 175° C.

With respect to the thus obtained specimen, tensile strength and disintegration rate measurements were made in which the specimens and testing methods are the same in Experiments 1 and 2 with the difference that the tensile strength was at ordinary temperature. The thus obtained test results are shown at the columns of "Strength" and "Disintegration rate" in Table 1.

TABLE 1

| Examples | Resin (parts by weight) | | Disintegration assistant: Principal component (parts by weight) | | Disintegration assistant: Gas generating compound (parts by weight) | | Strength kg/cm² | Disintegration rate weight % |
|---|---|---|---|---|---|---|---|---|
| Example 1 | Novolak type phenolic resin (SP-1640) | 100 | Calcium hydroxide | 0.5 | — | | 13.0 | 50 |
| | | | | 3 | | | 13.0 | 55 |
| | | | | 5 | | | 13.0 | 60 |
| | | | | 10 | | | 13.0 | 70 |
| | | | | 15 | | | 12.9 | 85 |
| | | | | 20 | | | 12.6 | 94 |
| | | | | 30 | | | 11.9 | 95 |
| | | | | 35 | | | 11.0 | 100 |
| Example 2 | Novolak type phenolic resin (SP-1640) | 100 | Calcium hydroxide | 10 | Sodium hydrogen-carbonate | 0.5 | 13.0 | 71 |
| | | | | | | 3 | 13.1 | 72 |
| | | | | | | 5 | 13.2 | 75 |
| | | | | | | 10 | 13.2 | 82 |
| | | | | | | 15 | 12.9 | 90 |
| | | | | | | 20 | 12.5 | 95 |
| | | | | | | 30 | 11.8 | 100 |
| | | | | | | 35 | 11.4 | 100 |
| Example 3 | Novolak type phenolic resin (SP-1640) | 100 | Calcium hydroxide | 10 | Azodi-carbonamide | 0.5 | 13.0 | 71 |
| | | | | | | 3 | 13.0 | 72 |
| | | | | | | 5 | 13.0 | 73 |
| | | | | | | 10 | 12.7 | 80 |
| | | | | | | 15 | 12.5 | 85 |
| | | | | | | 20 | 12.0 | 89 |
| | | | | | | 30 | 11.7 | 95 |
| | | | | | | 35 | 11.3 | 96 |
| Comparative Example 1 | Novolak type phenolic resin (SP-1640) | 100 | Calcium hydroxide | 0 | — | | 13.1 | 30 |
| | | | | 40 | | | 8.5 | 100 |
| Comparative Example 2 | Novolak type phenolic resin (SP-1640) | 100 | Calcium hydroxide | 10 | Sodium hydrogen-carbonate | 40 | 9.0 | 100 |
| Comparative Example 3 | Novolak type phenolic resin (SP-1640) | 100 | Calcium hydroxide | 10 | Azodi-carbonamide | 40 | 8.7 | 100 |
| Example 4 | Resol type phenolic resin (PS-2176) | 100 | Calcium hydroxide | 0.5 | — | | 10.5 | 72 |
| | | | | 3 | | | 10.4 | 75 |
| | | | | 5 | | | 10.0 | 81 |
| | | | | 10 | | | 10.1 | 87 |
| | | | | 15 | | | 10.0 | 95 |
| | | | | 20 | | | 8.0 | 95 |
| | | | | 30 | | | 7.5 | 100 |
| | | | | 35 | | | 7.2 | 100 |
| Example 5 | Resol type phenolic resin (PS-2176) | 100 | Calcium hydroxide | 10 | Zinc carbonate | 0.5 | 10.1 | 88 |
| | | | | | | 3 | 10.1 | 89 |
| | | | | | | 5 | 10.5 | 91 |
| | | | | | | 10 | 11.0 | 96 |
| | | | | | | 15 | 10.3 | 100 |
| | | | | | | 20 | 9.0 | 100 |
| | | | | | | 30 | 8.0 | 100 |
| | | | | | | 35 | 6.1 | 100 |
| Example 6 | Resol type phenolic resin (PS-2176) | 100 | Calcium hydroxide | 10 | d-Potassium hydrogen-tartrate | 0.5 | 10.0 | 88 |
| | | | | | | 3 | 10.0 | 89 |
| | | | | | | 5 | 9.9 | 90 |
| | | | | | | 10 | 9.7 | 90 |
| | | | | | | 15 | 9.0 | 96 |
| | | | | | | 20 | 7.0 | 100 |
| | | | | | | 30 | 6.0 | 100 |
| | | | | | | 35 | 5.7 | 100 |
| Comparative Example 4 | Resol type phenolic resin (PS-2176) | 100 | Calcium hydroxide | 0 | — | | 10.5 | 69 |
| | | | | 40 | | | 5.0 | 100 |
| Comparative Example 5 | Resol type phenolic resin | 100 | Calcium hydroxide | 10 | Zinc carbonate | 40 | 4.2 | 100 |

TABLE 1-continued

| Examples | Resin (parts by weight) | | Disintegration assistant: Principal component (parts by weight) | | Disintegration assistant: Gas generating compound (parts by weight) | | Strength kg/cm² | Disintegration rate weight % |
|---|---|---|---|---|---|---|---|---|
| Comparative Example 6 | (PS-2176) Resol type phenolic resin (PS-2176) | 100 | Calcium hydroxide | 10 | d-Potassium hydrogen-tartrate | 40 | 4.0 | 100 |
| Example 7 | Novolak type phenolic resin 60 + Resol type phenolic resin 40 (PS-2178) | | Calcium hydroxide | 0.5 | — | | 10.0 | 61 |
| | | | | 3 | | | 10.0 | 64 |
| | | | | 5 | | | 9.8 | 69 |
| | | | | 10 | | | 9.0 | 77 |
| | | | | 15 | | | 8.5 | 85 |
| | | | | 20 | | | 7.4 | 92 |
| | | | | 30 | | | 6.2 | 100 |
| | | | | 35 | | | 6.1 | 100 |
| Example 8 | Novolak type phenolic resin 60 + Resol type phenolic resin 40 (PS-2178) | | Calcium hydroxide | 10 | Zinc carbonate | 0.5 | 9.0 | 78 |
| | | | | | | 3 | 9.1 | 78 |
| | | | | | | 5 | 9.1 | 79 |
| | | | | | | 10 | 9.0 | 80 |
| | | | | | | 15 | 9.0 | 85 |
| | | | | | | 20 | 8.8 | 89 |
| | | | | | | 30 | 8.0 | 100 |
| | | | | | | 35 | 6.8 | 100 |
| Example 9 | Novolak type phenolic resin 60 + Resol type phenolic resin 40 (PS-2178) | | Calcium hydroxide | 10 | Sulfanilic acid | 0.5 | 9.0 | 78 |
| | | | | | | 3 | 9.0 | 79 |
| | | | | | | 5 | 9.0 | 80 |
| | | | | | | 10 | 8.6 | 81 |
| | | | | | | 15 | 8.2 | 85 |
| | | | | | | 20 | 7.9 | 90 |
| | | | | | | 30 | 6.7 | 100 |
| | | | | | | 35 | 5.9 | 100 |
| Comparative Example 7 | PS-2178 | 100 | Calcium hydroxide | 0 | — | | 10.0 | 59 |
| | | | | 40 | | | 4.0 | 100 |
| Comparative Example 8 | PS-2178 | 100 | Calcium hydroxide | 10 | Zinc carbonate | 40 | 5.0 | 100 |
| Comparative Example 9 | PS-2178 | 100 | Calcium hydroxide | 10 | Sulfanilic acid | 40 | 4.1 | 100 |
| Example 10 | Furan resin (KX-205) | 100 | Calcium hydroxide | 0.5 | — | | 18.7 | 59 |
| | | | | 3 | | | 18.6 | 60 |
| | | | | 5 | | | 18.5 | 67 |
| | | | | 10 | | | 18.2 | 77 |
| | | | | 15 | | | 18.0 | 87 |
| | | | | 20 | | | 17.3 | 95 |
| | | | | 30 | | | 16.0 | 100 |
| | | | | 35 | | | 15.0 | 100 |
| Example 11 | Furan resin (KX-205) | 100 | Calcium hydroxide | 10 | Zinc carbonate | 0.5 | 18.2 | 78 |
| | | | | | | 3 | 18.2 | 80 |
| | | | | | | 5 | 18.2 | 80 |
| | | | | | | 10 | 18.2 | 89 |
| | | | | | | 15 | 18.0 | 93 |
| | | | | | | 20 | 17.5 | 95 |
| | | | | | | 30 | 16.8 | 100 |
| | | | | | | 35 | 15.5 | 100 |
| Example 12 | Furan resin (KX-205) | 100 | Calcium hydroxide | 10 | Azodi-carbonamide | 0.5 | 18.2 | 78 |
| | | | | | | 3 | 18.2 | 79 |
| | | | | | | 5 | 18.2 | 81 |
| | | | | | | 10 | 18.2 | 87 |
| | | | | | | 15 | 17.5 | 94 |
| | | | | | | 20 | 16.5 | 96 |
| | | | | | | 30 | 15.8 | 100 |
| | | | | | | 35 | 15.0 | 100 |
| Comparative Example 10 | Furan resin (KX-205) | 100 | Calcium hydroxide | 0 | — | | 18.7 | 58 |
| | | | | 40 | | | 12.7 | 100 |
| Comparative Example 11 | Furan resin (KX-205) | 100 | Calcium hydroxide | 10 | Zinc carbonate | 40 | 13.0 | 100 |
| Comparative Example 12 | Furan resin (KX-205) | 100 | Calcium hydroxide | 10 | Azodi-carbonamide | 40 | 12.1 | 100 |

TABLE 1-continued

| Examples | Resin (parts by weight) | | Disintegration assistant: Principal component (parts by weight) | | Disintegration assistant: Gas generating compound (parts by weight) | | Strength kg/cm² | Disintegration rate weight % |
|---|---|---|---|---|---|---|---|---|
| Example 13 | Novolak type phenolic resin (SP-1640) | 100 | Calcium carbonate | 0.5 | — | | 13.0 | 45 |
| | | | | 3 | | | 12.9 | 48 |
| | | | | 5 | | | 13.0 | 53 |
| | | | | 10 | | | 12.9 | 65 |
| | | | | 15 | | | 12.9 | 75 |
| | | | | 20 | | | 13.0 | 85 |
| | | | | 30 | | | 12.5 | 88 |
| | | | | 35 | | | 11.0 | 93 |
| Example 14 | Novolak type phenolic resin (SP-1640) | 100 | Calcium carbonate | 10 | Sodium hydrogen-carbonate | 0.5 | 13.1 | 68 |
| | | | | | | 3 | 13.0 | 70 |
| | | | | | | 5 | 13.2 | 73 |
| | | | | | | 10 | 13.1 | 81 |
| | | | | | | 15 | 12.8 | 88 |
| | | | | | | 20 | 12.5 | 93 |
| | | | | | | 30 | 12.2 | 95 |
| | | | | | | 35 | 11.5 | 95 |
| Example 15 | Novolak type phenolic resin (SP-1640) | 100 | Calcium carbonate | 10 | Azodi-carbonamide | 0.5 | 13.0 | 67 |
| | | | | | | 3 | 12.5 | 68 |
| | | | | | | 5 | 12.2 | 70 |
| | | | | | | 10 | 12.0 | 74 |
| | | | | | | 15 | 11.5 | 83 |
| | | | | | | 20 | 11.2 | 86 |
| | | | | | | 30 | 10.8 | 89 |
| | | | | | | 35 | 10.5 | 90 |
| Comparative Example 13 | Novolak type phenolic resin (SP-1640) | 100 | Calcium carbonate | 0 | — | | 13.1 | 30 |
| | | | | 40 | | | 9.0 | 94 |
| Comparative Example 14 | Novolak type phenolic resin (SP-1640) | 100 | Calcium carbonate | 10 | Sodium hydrogen-carbonate | 40 | 9.5 | 95 |
| Comparative Example 15 | Novolak type phenolic resin (SP-1640) | 100 | Calcium carbonate | 10 | Azodi-carbonamide | 40 | 9.0 | 90 |
| Example 16 | Resol type phenolic resin (PS-2176) | 100 | Calcium carbonate | 0.5 | — | | 10.5 | 75 |
| | | | | 3 | | | 10.4 | 80 |
| | | | | 5 | | | 10.5 | 82 |
| | | | | 10 | | | 10.3 | 87 |
| | | | | 15 | | | 10.2 | 92 |
| | | | | 20 | | | 9.3 | 94 |
| | | | | 30 | | | 9.0 | 98 |
| | | | | 35 | | | 8.1 | 98 |
| Example 17 | Resol type phenolic resin (PS-2176) | 100 | Calcium carbonate | 10 | Zinc carbonate | 0.5 | 10.2 | 88 |
| | | | | | | 3 | 10.7 | 89 |
| | | | | | | 5 | 11.2 | 95 |
| | | | | | | 10 | 11.5 | 98 |
| | | | | | | 15 | 10.7 | 98 |
| | | | | | | 20 | 10.3 | 98 |
| | | | | | | 30 | 9.0 | 100 |
| | | | | | | 35 | 8.1 | 100 |
| Example 18 | Resol type phenolic resin (PS-2176) | 100 | Calcium carbonate | 10 | d-Potassium hydrogen-tartrate | 0.5 | 10.2 | 87 |
| | | | | | | 3 | 10.0 | 88 |
| | | | | | | 5 | 9.8 | 90 |
| | | | | | | 10 | 9.5 | 93 |
| | | | | | | 15 | 9.0 | 98 |
| | | | | | | 20 | 8.5 | 98 |
| | | | | | | 30 | 7.5 | 100 |
| | | | | | | 35 | 7.0 | 100 |
| Comparative Example 16 | Resol type phenolic resin (PS-2176) | 100 | Calcium carbonate | 0 | — | | 10.5 | 69 |
| | | | | 40 | | | 5.5 | 98 |
| Comparative Example 17 | Resol type phenolic resin (PS-2176) | 100 | Calcium carbonate | 10 | Zinc carbonate | 40 | 6.5 | 100 |
| Comparative Example 18 | Resol type | 100 | Calcium carbonate | 10 | d-Potassium hydrogen- | 40 | 5.0 | 100 |

TABLE 1-continued

| Examples | Resin (parts by weight) | Disintegration assistant: Principal component (parts by weight) | | Disintegration assistant: Gas generating compound (parts by weight) | | Strength kg/cm² | Disintegration rate weight % |
|---|---|---|---|---|---|---|---|
| | phenolic resin (PS-2176) | | | tartrate | | | |
| Example 19 | Novolak type phenolic resin 60 + Resol type phenolic resin 40 (PS-2178) | Calcium carbonate | 0.5 | — | | 10.1 | 69 |
| | | | 3 | | | 10.3 | 72 |
| | | | 5 | | | 11.1 | 76 |
| | | | 10 | | | 11.5 | 80 |
| | | | 15 | | | 10.7 | 91 |
| | | | 20 | | | 9.7 | 100 |
| | | | 30 | | | 8.7 | 100 |
| | | | 35 | | | 8.0 | 100 |
| Example 20 | Novolak type phenolic resin 60 + Resol type phenolic resin (PS-2178) | Calcium carbonate | 10 | Zinc carbonate | 0.5 | 11.6 | 82 |
| | | | | | 3 | 11.7 | 85 |
| | | | | | 5 | 11.9 | 88 |
| | | | | | 10 | 12.0 | 95 |
| | | | | | 15 | 11.7 | 97 |
| | | | | | 20 | 11.3 | 98 |
| | | | | | 30 | 10.5 | 100 |
| | | | | | 35 | 8.7 | 100 |
| Example 21 | Novolak type phenolic resin 60 + Resol type phenolic resin 40 (PS-2178) | Calcium carbonate | 10 | Sulfanilic acid | 0.5 | 11.0 | 81 |
| | | | | | 3 | 10.9 | 83 |
| | | | | | 5 | 10.7 | 85 |
| | | | | | 10 | 10.4 | 92 |
| | | | | | 15 | 10.1 | 95 |
| | | | | | 20 | 9.5 | 95 |
| | | | | | 30 | 8.4 | 98 |
| | | | | | 35 | 7.8 | 98 |
| Comparative Example 19 | PS-2178 100 | Calcium carbonate | 0 | — | | 10.0 | 59 |
| | | | 40 | | | 6.0 | 100 |
| Comparative Example 20 | PS-2178 100 | Calcium carbonate | 10 | Zinc carbonate | 40 | 6.1 | 100 |
| Comparative Example 21 | PS-2178 100 | Calcium carbonate | 10 | Sulfanilic acid | 40 | 6.2 | 98 |
| Example 22 | Furan resin (KX-205) 100 | Calcium carbonate | 0.5 | — | | 18.7 | 60 |
| | | | 3 | | | 18.7 | 61 |
| | | | 5 | | | 18.7 | 63 |
| | | | 10 | | | 18.8 | 70 |
| | | | 15 | | | 18.3 | 75 |
| | | | 20 | | | 18.0 | 85 |
| | | | 30 | | | 17.5 | 92 |
| | | | 35 | | | 16.1 | 98 |
| Example 23 | Furan resin (KX-205) 100 | Calcium carbonate | 10 | Zinc carbonate | 0.5 | 18.9 | 73 |
| | | | | | 3 | 19.0 | 77 |
| | | | | | 5 | 19.2 | 78 |
| | | | | | 10 | 19.3 | 83 |
| | | | | | 15 | 19.0 | 88 |
| | | | | | 20 | 18.3 | 89 |
| | | | | | 30 | 17.3 | 93 |
| | | | | | 35 | 16.3 | 100 |
| Example 24 | Furan resin (KX-205) 100 | Calcium carbonate | 10 | Azodi-carbonamide | 0.5 | 18.1 | 73 |
| | | | | | 3 | 18.1 | 75 |
| | | | | | 5 | 18.1 | 77 |
| | | | | | 10 | 18.0 | 80 |
| | | | | | 15 | 17.6 | 88 |
| | | | | | 20 | 16.9 | 95 |
| | | | | | 30 | 16.3 | 97 |
| | | | | | 35 | 15.7 | 97 |
| Comparative Example 22 | Furan resin (KX-205) 100 | Calcium carbonate | 0 | — | | 18.7 | 58 |
| | | | 40 | | | 14.3 | 100 |
| Comparative Example 23 | Furan resin (KX-205) 100 | Calcium carbonate | 10 | Zinc carbonate | 40 | 15.4 | 100 |
| Comparative Example 24 | Furan resin (KX-205) 100 | Calcium carbonate | 10 | Azodi-carbonamide | 40 | 15.0 | 100 |
| Example 25 | Novolak type phenolic resin 100 | Barium hydroxide | 0.5 | — | | 13.1 | 35 |
| | | | 3 | | | 13.0 | 49 |
| | | | 5 | | | 12.8 | 55 |
| | | | 10 | | | 12.4 | 66 |

TABLE 1-continued

| Examples | Resin (parts by weight) | | Disintegration assistant: Principal component (parts by weight) | | Disintegration assistant: Gas generating compound (parts by weight) | | Strength kg/cm$^2$ | Disintegration rate weight % |
|---|---|---|---|---|---|---|---|---|
| | (SP-1640) | | | 15 | | | 11.8 | 80 |
| | | | | 20 | | | 11.0 | 90 |
| | | | | 30 | | | 10.5 | 92 |
| | | | | 35 | | | 10.0 | 96 |
| Example 26 | Novolak type phenolic resin (SP-1640) | 100 | Barium hydroxide | 10 | Sodium hydrogen-carbonate | 0.5 | 12.4 | 68 |
| | | | | | | 3 | 12.4 | 69 |
| | | | | | | 5 | 12.2 | 71 |
| | | | | | | 10 | 11.9 | 78 |
| | | | | | | 15 | 11.5 | 85 |
| | | | | | | 20 | 11.0 | 92 |
| | | | | | | 30 | 10.5 | 95 |
| | | | | | | 35 | 10.0 | 100 |
| Example 27 | Novolak type phenolic resin (SP-1640) | 100 | Barium hydroxide | 10 | Azodi-carbonamide | 0.5 | 12.4 | 67 |
| | | | | | | 3 | 12.4 | 68 |
| | | | | | | 5 | 12.2 | 68 |
| | | | | | | 10 | 12.3 | 70 |
| | | | | | | 15 | 12.0 | 73 |
| | | | | | | 20 | 11.8 | 75 |
| | | | | | | 30 | 11.5 | 79 |
| | | | | | | 35 | 11.0 | 85 |
| Comparative Example 25 | Novolak type phenolic resin (SP-1640) | 100 | Barium hydroxide | 0 | — | | 13.1 | 30 |
| | | | | 40 | | | 9.0 | 98 |
| Comparative Example 26 | Novolak type phenolic resin (SP-1640) | 100 | Barium hydroxide | 10 | Sodium hydrogen-carbonate | 40 | 8.9 | 100 |
| Comparative Example 27 | Novolak type phenolic resin (SP-1640) | 100 | Barium hydroxide | 10 | Azodi-carbonamide | 40 | 9.9 | 93 |
| Example 28 | Resol type phenolic resin (PS-2176) | 100 | Barium hydroxide | 0.5 | — | | 10.4 | 70 |
| | | | | 3 | | | 9.8 | 73 |
| | | | | 5 | | | 9.3 | 75 |
| | | | | 10 | | | 8.3 | 83 |
| | | | | 15 | | | 7.3 | 89 |
| | | | | 20 | | | 7.2 | 92 |
| | | | | 30 | | | 6.2 | 94 |
| | | | | 35 | | | 6.0 | 100 |
| Example 29 | Resol type phenolic resin (PS-2176) | 100 | Barium hydroxide | 10 | Zinc carbonate | 0.5 | 8.3 | 85 |
| | | | | | | 3 | 8.2 | 84 |
| | | | | | | 5 | 8.1 | 85 |
| | | | | | | 10 | 8.0 | 86 |
| | | | | | | 15 | 7.5 | 90 |
| | | | | | | 20 | 7.3 | 93 |
| | | | | | | 30 | 6.5 | 96 |
| | | | | | | 35 | 6.8 | 100 |
| Example 30 | Resol type phenolic resin (PS-2176) | 100 | Barium hydroxide | 10 | d-Potassium hydrogen-tartrate | 0.5 | 8.3 | 86 |
| | | | | | | 3 | 8.2 | 87 |
| | | | | | | 5 | 8.1 | 88 |
| | | | | | | 10 | 8.0 | 90 |
| | | | | | | 15 | 7.5 | 91 |
| | | | | | | 20 | 7.1 | 95 |
| | | | | | | 30 | 6.6 | 96 |
| | | | | | | 35 | 6.0 | 100 |
| Comparative Example 28 | Resol type phenolic resin (PS-2176) | 100 | Barium hydroxide | 0 | — | | 10.5 | 69 |
| | | | | 40 | | | 4.2 | 100 |
| Comparative Example 29 | Resol type phenolic resin (PS-2176) | 100 | Barium hydroxide | 10 | Zinc carbonate | 40 | 4.5 | 100 |
| Comparative Example 30 | Resol type phenolic resin (PS-2176) | 100 | Barium hydroxide | 10 | d-Potassium hydrogen-tartrate | 40 | 3.9 | 100 |
| Example 31 | Novolak | | Barium | 0.5 | — | | 9.9 | 60 |

TABLE 1-continued

| Examples | Resin (parts by weight) | | Disintegration assistant: Principal component (parts by weight) | | Disintegration assistant: Gas generating compound (parts by weight) | | Strength kg/cm$^2$ | Disintegration rate weight % |
|---|---|---|---|---|---|---|---|---|
| | type phenolic resin 60 + Resol type phenolic resin 40 (PS-2178) | | hydroxide | 3 | | | 9.5 | 62 |
| | | | | 5 | | | 9.2 | 65 |
| | | | | 10 | | | 8.3 | 75 |
| | | | | 15 | | | 7.5 | 79 |
| | | | | 20 | | | 7.0 | 86 |
| | | | | 30 | | | 6.2 | 92 |
| | | | | 35 | | | 6.0 | 92 |
| Example 32 | Novolak type phenolic resin 60 + Resol type phenolic resin 40 (PS-2178) | | Barium hydroxide | 10 | Zinc carbonate | 0.5 | 8.3 | 76 |
| | | | | | | 3 | 8.4 | 77 |
| | | | | | | 5 | 8.5 | 79 |
| | | | | | | 10 | 8.4 | 87 |
| | | | | | | 15 | 8.2 | 92 |
| | | | | | | 20 | 7.9 | 94 |
| | | | | | | 30 | 7.1 | 94 |
| | | | | | | 35 | 6.5 | 96 |
| Example 33 | Novolak type phenolic resin 60 + Resol type phenolic resin (PS-2178) | | Barium hydroxide | 10 | Sulfanilic acid | 0.5 | 8.3 | 76 |
| | | | | | | 3 | 8.2 | 78 |
| | | | | | | 5 | 8.0 | 80 |
| | | | | | | 10 | 7.8 | 82 |
| | | | | | | 15 | 7.5 | 85 |
| | | | | | | 20 | 7.4 | 86 |
| | | | | | | 30 | 6.9 | 94 |
| | | | | | | 35 | 6.2 | 98 |
| Comparative Example 31 | PS-2178 | 100 | Barium hydroxide | 0 | — | | 10.0 | 59 |
| | | | | 40 | | | 5.1 | 100 |
| Comparative Example 32 | PS-2178 | 100 | Barium hydroxide | 10 | Zinc carbonate | 40 | 5.2 | 98 |
| Comparative Example 33 | PS-2178 | 100 | Barium hydroxide | 10 | Sulfanilic acid | 40 | 4.9 | 100 |
| Example 34 | Furan resin (KX-205) | 100 | Barium hydroxide | 0.5 | — | | 18.7 | 59 |
| | | | | 3 | | | 18.6 | 60 |
| | | | | 5 | | | 18.5 | 63 |
| | | | | 10 | | | 18.2 | 68 |
| | | | | 15 | | | 17.7 | 75 |
| | | | | 20 | | | 17.2 | 83 |
| | | | | 30 | | | 16.0 | 98 |
| | | | | 35 | | | 15.2 | 100 |
| Example 35 | Furan resin (KX-205) | 100 | Barium hydroxide | 10 | Zinc carbonate | 0.5 | 18.2 | 69 |
| | | | | | | 3 | 18.0 | 70 |
| | | | | | | 5 | 17.8 | 73 |
| | | | | | | 10 | 17.5 | 73 |
| | | | | | | 15 | 17.1 | 80 |
| | | | | | | 20 | 16.5 | 86 |
| | | | | | | 30 | 15.5 | 91 |
| | | | | | | 35 | 15.0 | 99 |
| Example 36 | Furan resin (KX-205) | 100 | Barium hydroxide | 10 | Azodi-carbonamide | 0.5 | 18.2 | 70 |
| | | | | | | 3 | 18.1 | 71 |
| | | | | | | 5 | 18.1 | 75 |
| | | | | | | 10 | 17.9 | 75 |
| | | | | | | 15 | 17.8 | 79 |
| | | | | | | 20 | 17.5 | 83 |
| | | | | | | 30 | 16.2 | 89 |
| | | | | | | 35 | 15.4 | 98 |
| Comparative Example 34 | Furan resin (KX-205) | 100 | Barium hydroxide | 0 | — | | 18.7 | 58 |
| | | | | 40 | | | 14.2 | 100 |
| Comparative Example 35 | Furan resin (KX-205) | 100 | Barium hydroxide | 10 | Zinc carbonate | 40 | 13.8 | 100 |
| Comparative Example 36 | Furan resin (KX-205) | 100 | Barium hydroxide | 10 | Azodi-carbonamide | 40 | 13.4 | 100 |
| Example 37 | Novolak type phenolic resin (SP-1640) | 100 | Barium carbonate | 0.5 | — | | 13.0 | 50 |
| | | | | 3 | | | 13.2 | 53 |
| | | | | 5 | | | 13.2 | 58 |
| | | | | 10 | | | 12.8 | 65 |
| | | | | 15 | | | 12.5 | 75 |
| | | | | 20 | | | 11.5 | 90 |
| | | | | 30 | | | 11.0 | 95 |
| | | | | 35 | | | 10.5 | 95 |

TABLE 1-continued

| Examples | Resin (parts by weight) | | Disintegration assistant: Principal component (parts by weight) | | Disintegration assistant: Gas generating compound (parts by weight) | | Strength kg/cm$^2$ | Disintegration rate weight % |
|---|---|---|---|---|---|---|---|---|
| Example 38 | Novolak type phenolic resin (SP-1640) | 100 | Barium carbonate | 10 | Sodium hydrogen-carbonate | 0.5 | 12.8 | 68 |
| | | | | | | 3 | 12.8 | 72 |
| | | | | | | 5 | 11.9 | 77 |
| | | | | | | 10 | 12.0 | 82 |
| | | | | | | 15 | 11.7 | 90 |
| | | | | | | 20 | 11.2 | 95 |
| | | | | | | 30 | 11.0 | 95 |
| | | | | | | 35 | 10.3 | 100 |
| Example 39 | Novolak type phenolic resin (SP-1640) | 100 | Barium carbonate | 10 | Azodi-carbonamide | 0.5 | 13.0 | 70 |
| | | | | | | 3 | 13.0 | 70 |
| | | | | | | 5 | 13.1 | 72 |
| | | | | | | 10 | 12.5 | 77 |
| | | | | | | 15 | 11.9 | 79 |
| | | | | | | 20 | 11.5 | 85 |
| | | | | | | 30 | 11.3 | 90 |
| | | | | | | 35 | 10.9 | 100 |
| Comparative Example 37 | Novolak type phenolic resin (SP-1640) | 100 | Barium carbonate | 0 | — | | 13.1 | 30 |
| | | | | 40 | | | 7.1 | 100 |
| Comparative Example 38 | Novolak type phenolic resin (SP-1640) | 100 | Barium carbonate | 10 | Sodium hydrogen-carbonate | 40 | 8.2 | 100 |
| Comparative Example 39 | Novolak type phenolic resin (SP-1640) | 100 | Barium carbonate | 10 | Azodi-carbonamide | 40 | 8.1 | 100 |
| Example 40 | Resol type phenolic resin (PS-2176) | 100 | Barium carbonate | 0.5 | — | | 10.5 | 70 |
| | | | | 3 | | | 10.3 | 73 |
| | | | | 5 | | | 10.1 | 76 |
| | | | | 10 | | | 9.8 | 82 |
| | | | | 15 | | | 9.3 | 86 |
| | | | | 20 | | | 8.5 | 93 |
| | | | | 30 | | | 6.3 | 100 |
| | | | | 35 | | | 6.0 | 100 |
| Example 41 | Resol type phenolic resin (PS-2176) | 100 | Barium carbonate | 10 | Zinc carbonate | 0.5 | 9.8 | 83 |
| | | | | | | 3 | 10.0 | 83 |
| | | | | | | 5 | 10.1 | 83 |
| | | | | | | 10 | 10.2 | 87 |
| | | | | | | 15 | 9.3 | 90 |
| | | | | | | 20 | 8.1 | 91 |
| | | | | | | 30 | 6.6 | 98 |
| | | | | | | 35 | 6.0 | 100 |
| Example 42 | Resol type phenolic resin (PS-2176) | 100 | Barium carbonate | 10 | d-Potassium hydrogen-tartrate | 0.5 | 9.7 | 83 |
| | | | | | | 3 | 9.5 | 84 |
| | | | | | | 5 | 9.3 | 86 |
| | | | | | | 10 | 9.0 | 88 |
| | | | | | | 15 | 8.7 | 92 |
| | | | | | | 20 | 8.5 | 95 |
| | | | | | | 30 | 7.6 | 97 |
| | | | | | | 35 | 7.3 | 98 |
| Comparative Example 40 | Resol type phenolic resin (PS-2176) | 100 | Barium carbonate | 0 | — | | 10.5 | 69 |
| | | | | 40 | | | 5.3 | 100 |
| Comparative Example 41 | Resol type phenolic resin (PS-2176) | 100 | Barium carbonate | 10 | Zinc carbonate | 40 | 5.0 | 100 |
| Comparative Example 42 | Resol type phenolic resin (PS-2176) | 100 | Barium carbonate | 10 | d-Potassium hydrogen-tartrate | 40 | 6.8 | 99 |
| Example 43 | Novolak type phenolic resin 60 + | | Barium carbonate | 0.5 | — | | 9.9 | 60 |
| | | | | 3 | | | 9.8 | 61 |
| | | | | 5 | | | 9.8 | 63 |
| | | | | 10 | | | 9.5 | 65 |
| | | | | 15 | | | 9.3 | 69 |

TABLE 1-continued

| Examples | Resin (parts by weight) | | Disintegration assistant: Principal component (parts by weight) | | Disintegration assistant: Gas generating compound (parts by weight) | | Strength kg/cm$^2$ | Disintegration rate weight % |
|---|---|---|---|---|---|---|---|---|
| | Resol type phenolic resin 40 (PS-2178) | | | 20 | | | 8.8 | 73 |
| | | | | 30 | | | 7.1 | 88 |
| | | | | 35 | | | 6.3 | 93 |
| Example 44 | Novolak type phenolic resin 60 + Resol type phenolic resin 40 (PS-2178) | | Barium carbonate | 10 | Zinc carbonate | 0.5 | 9.5 | 66 |
| | | | | | | 3 | 9.5 | 68 |
| | | | | | | 5 | 9.5 | 70 |
| | | | | | | 10 | 9.4 | 79 |
| | | | | | | 15 | 9.2 | 88 |
| | | | | | | 20 | 8.7 | 93 |
| | | | | | | 30 | 7.7 | 95 |
| | | | | | | 35 | 7.0 | 96 |
| Example 45 | Novolak type phenolic resin 60 + Resol type phenolic resin 40 (PS-2178) | | Barium carbonate | 10 | Sulfanilic acid | 0.5 | 9.5 | 66 |
| | | | | | | 3 | 9.4 | 66 |
| | | | | | | 5 | 9.4 | 68 |
| | | | | | | 10 | 9.3 | 70 |
| | | | | | | 15 | 8.9 | 74 |
| | | | | | | 20 | 8.2 | 79 |
| | | | | | | 30 | 6.4 | 88 |
| | | | | | | 35 | 6.0 | 95 |
| Comparative Example 43 | PS-2178 | 100 | Barium carbonate | 0 | — | | 10.0 | 59 |
| | | | | 40 | | | 5.5 | 100 |
| Comparative Example 44 | PS-2178 | 100 | Barium carbonate | 10 | Zinc carbonate | 40 | 6.5 | 98 |
| Comparative Example 45 | PS-2178 | 100 | Barium carbonate | 10 | Sulfanilic acid | 40 | 4.9 | 100 |
| Example 46 | Furan resin (KX-205) | 100 | Barium carbonate | 0.5 | — | | 18.6 | 59 |
| | | | | 3 | | | 18.5 | 60 |
| | | | | 5 | | | 18.5 | 68 |
| | | | | 10 | | | 17.8 | 73 |
| | | | | 15 | | | 17.3 | 79 |
| | | | | 20 | | | 16.0 | 85 |
| | | | | 30 | | | 15.5 | 92 |
| | | | | 35 | | | 15.0 | 100 |
| Example 47 | Furan resin (KX-205) | 100 | Barium carbonate | 10 | Zinc carbonate | 0.5 | 17.8 | 75 |
| | | | | | | 3 | 17.8 | 79 |
| | | | | | | 5 | 16.9 | 80 |
| | | | | | | 10 | 16.5 | 85 |
| | | | | | | 15 | 15.8 | 89 |
| | | | | | | 20 | 15.2 | 93 |
| | | | | | | 30 | 14.2 | 97 |
| | | | | | | 35 | 14.2 | 100 |
| Example 48 | Furan resin (KX-205) | 100 | Barium carbonate | 10 | Azodicarbonamide | 0.5 | 17.6 | 75 |
| | | | | | | 3 | 17.4 | 80 |
| | | | | | | 5 | 17.0 | 84 |
| | | | | | | 10 | 16.8 | 88 |
| | | | | | | 15 | 16.0 | 90 |
| | | | | | | 20 | 15.3 | 92 |
| | | | | | | 30 | 14.9 | 94 |
| | | | | | | 35 | 14.0 | 96 |
| Comparative Example 46 | Furan resin (KX-205) | 100 | Barium carbonate | 0 | — | | 18.7 | 58 |
| | | | | 40 | | | 13.8 | 100 |
| Comparative Example 47 | Furan resin (KX-205) | 100 | Barium carbonate | 10 | Zinc carbonate | 40 | 13.7 | 100 |
| Comparative Example 48 | Furan resin (KX-205) | 100 | Barium carbonate | 10 | Azodicarbonamide | 40 | 13.4 | 98 |
| Example 49 | Novolak type phenolic resin 60 + Resol type phenolic resin 40 (PS-2178) | | Calcium hydroxide (50) + Calcium carbonate (50) | 0.5 | — | | 10.0 | 63 |
| | | | | 3 | | | 10.0 | 68 |
| | | | | 5 | | | 9.7 | 75 |
| | | | | 10 | | | 9.3 | 79 |
| | | | | 15 | | | 9.0 | 85 |
| | | | | 20 | | | 8.5 | 90 |
| | | | | 30 | | | 8.3 | 100 |
| | | | | 35 | | | 7.5 | 100 |

TABLE 1-continued

| Examples | Resin (parts by weight) | Disintegration assistant: Principal component (parts by weight) | | Disintegration assistant: Gas generating compound (parts by weight) | | Strength kg/cm$^2$ | Disintegration rate weight % |
|---|---|---|---|---|---|---|---|
| Example 50 | Novolak type phenolic resin 60 + Resol type phenolic resin 40 (PS-2178) | Calcium hydroxide (50) + Calcium carbonate (50) | 10 | Zinc carbonate | 0.5 | 9.3 | 81 |
| | | | | | 3 | 9.3 | 83 |
| | | | | | 5 | 9.2 | 84 |
| | | | | | 10 | 9.0 | 92 |
| | | | | | 15 | 8.5 | 99 |
| | | | | | 20 | 8.1 | 100 |
| | | | | | 30 | 7.5 | 100 |
| | | | | | 35 | 7.3 | 100 |
| Comparative Example 49 | Novolak type phenolic resin 60 + Resol type phenolic resin 40 (PS-2178) | Calcium hydroxide (50) + Calcium carbonate (50) | 0 | — | | 10.0 | 59 |
| | | | 40 | | | 5.9 | 100 |
| Comparative Example 50 | Novolak type phenolic resin 60 + Resol type phenolic resin 40 (PS-2178) | Calcium hydroxide (50) + Calcium carbonate (50) | 10 | Zinc carbonate | 40 | 6.9 | 100 |
| Example 51 | Novolak type phenolic resin 60 + Resol type phenolic resin 40 (PS-2178) | Calcium hydroxide (50) + Barium hydroxide (50) | 0.5 | — | | 10.0 | 62 |
| | | | 3 | | | 10.0 | 65 |
| | | | 5 | | | 9.8 | 67 |
| | | | 10 | | | 9.5 | 73 |
| | | | 15 | | | 9.2 | 80 |
| | | | 20 | | | 9.0 | 86 |
| | | | 30 | | | 8.5 | 90 |
| | | | 35 | | | 7.9 | 94 |
| Example 52 | Novolak type phenolic resin 60 + Resol type phenolic resin 40 (PS-2178) | Calcium hydroxide (50) + Barium hydroxide (50) | 10 | Zinc carbonate | 0.5 | 9.5 | 74 |
| | | | | | 3 | 9.7 | 74 |
| | | | | | 5 | 10.1 | 75 |
| | | | | | 10 | 10.5 | 82 |
| | | | | | 15 | 9.7 | 88 |
| | | | | | 20 | 8.9 | 95 |
| | | | | | 30 | 8.4 | 100 |
| | | | | | 35 | 7.9 | 100 |
| Comparative Example 51 | Novolak type phenolic resin 60 + Resol type phenolic resin 40 (PS-2178) | Calcium hydroxide (50) + Barium hydroxide (50) | 0 | — | | 10.0 | 59 |
| | | | 40 | | | 5.9 | 100 |
| Comparative Example 52 | Novolak type phenolic resin 60 + Resol type phenolic resin | Calcium hydroxide (50) + Barium hydroxide (50) | 10 | Zinc carbonate | 40 | 5.2 | 100 |

TABLE 1-continued

| Examples | Resin (parts by weight) | Disintegration assistant: Principal component (parts by weight) | | Disintegration assistant: Gas generating compound (parts by weight) | | Strength kg/cm² | Disintegration rate weight % |
|---|---|---|---|---|---|---|---|
| | 40 (PS-2178) | | | | | | |
| Example 53 | Novolak type phenolic resin 60 + Resol type phenolic resin 40 (PS-2178) | Calcium hydroxide (50) + Barium carbonate (50) | 0.5 | — | | 10.0 | 61 |
| | | | 3 | | | 10.0 | 64 |
| | | | 5 | | | 9.7 | 65 |
| | | | 10 | | | 9.6 | 70 |
| | | | 15 | | | 9.3 | 76 |
| | | | 20 | | | 8.9 | 82 |
| | | | 30 | | | 8.6 | 88 |
| | | | 35 | | | 8.1 | 95 |
| Example 54 | Novolak type phenolic resin 60 + Resol type phenolic resin 40 (PS-2178) | Calcium hydroxide (50) + Barium carbonate (50) | 10 | Zinc carbonate | 0.5 | 9.6 | 72 |
| | | | | | 3 | 9.6 | 73 |
| | | | | | 5 | 9.9 | 73 |
| | | | | | 10 | 10.5 | 76 |
| | | | | | 15 | 10.6 | 81 |
| | | | | | 20 | 9.1 | 85 |
| | | | | | 30 | 8.9 | 90 |
| | | | | | 35 | 8.7 | 97 |
| Comparative Example 53 | Novolak type phenolic resin 60 + Resol type phenolic resin 40 (PS-2178) | Calcium hydroxide (50) + Barium carbonate (50) | 0 | — | | 10.0 | 59 |
| | | | 40 | | | 6.5 | 98 |
| Comparative Example 54 | Novolak type phenolic resin 60 + Resol type phenolic resin 40 (PS-2178) | Calcium hydroxide (50) + Barium carbonate (50) | 10 | Zinc carbonate | 40 | 6.1 | 100 |
| Example 55 | Novolak type phenolic resin 60 + Resol type phenolic resin 40 (PS-2178) | Calcium carbonate (50) + Barium hydroxide (50) | 0.5 | — | | 10.0 | 61 |
| | | | 3 | | | 10.0 | 64 |
| | | | 5 | | | 9.9 | 68 |
| | | | 10 | | | 9.7 | 76 |
| | | | 15 | | | 9.5 | 82 |
| | | | 20 | | | 9.2 | 88 |
| | | | 30 | | | 8.8 | 98 |
| | | | 35 | | | 8.5 | 100 |
| Example 56 | Novolak type phenolic resin 60 + Resol type phenolic resin 40 (PS-2178) | Calcium carbonate (50) + Barium hydroxide (50) | 10 | Zinc carbonate | 0.5 | 9.7 | 77 |
| | | | | | 3 | 9.9 | 77 |
| | | | | | 5 | 10.5 | 79 |
| | | | | | 10 | 10.6 | 85 |
| | | | | | 15 | 9.5 | 91 |
| | | | | | 20 | 9.1 | 98 |
| | | | | | 30 | 8.7 | 100 |
| | | | | | 35 | 8.4 | 100 |
| Comparative Example 55 | Novolak type phenolic resin 60 + Resol type | Calcium carbonate (50) + Barium hydroxide (50) | 0 | — | | 10.0 | 59 |
| | | | 40 | | | 6.9 | 100 |

TABLE 1-continued

| Examples | Resin (parts by weight) | Disintegration assistant: Principal component (parts by weight) | | Disintegration assistant: Gas generating compound (parts by weight) | | Strength kg/cm$^2$ | Disintegration rate weight % |
|---|---|---|---|---|---|---|---|
| | phenolic resin 40 (PS-2178) | | | | | | |
| Comparative Example 56 | Novolak type phenolic resin 60 + Resol type phenolic resin 40 (PS-2178) | Calcium carbonate (50) + Barium hydroxide (50) | 10 | Zinc carbonate | 40 | 6.7 | 100 |
| Example 57 | Novolak type phenolic resin 60 + Resol type phenolic resin 40 (PS-2178) | Calcium carbonate (50) + Barium carbonate (50) | 0.5 | — | | 10.0 | 62 |
| | | | 3 | | | 10.0 | 66 |
| | | | 5 | | | 10.0 | 70 |
| | | | 10 | | | 9.8 | 75 |
| | | | 15 | | | 9.6 | 80 |
| | | | 20 | | | 9.3 | 87 |
| | | | 30 | | | 9.0 | 95 |
| | | | 35 | | | 8.5 | 100 |
| Example 58 | Novolak type phenolic resin 60 + Resol type phenolic resin 40 (PS-2178) | Calcium carbonate (50) + Barium carbonate (50) | 10 | Zinc carbonate | 0.5 | 9.8 | 77 |
| | | | | | 3 | 9.7 | 78 |
| | | | | | 5 | 9.7 | 78 |
| | | | | | 10 | 9.7 | 81 |
| | | | | | 15 | 9.4 | 90 |
| | | | | | 20 | 9.0 | 98 |
| | | | | | 30 | 8.5 | 100 |
| | | | | | 35 | 7.9 | 100 |
| Comparative Example 57 | Novolak type phenolic resin 60 + Resol type phenolic resin 40 (PS-2178) | Calcium carbonate (50) + Barium carbonate (50) | 0 | — | | 10.0 | 59 |
| | | | 40 | | | 6.9 | 100 |
| Comparative Example 58 | Novolak type phenolic resin 60 + Resol type phenolic resin 40 (PS-2178) | Calcium carbonate (50) + Barium carbonate (50) | 10 | Zinc carbonate | 40 | 6.1 | 100 |

What is claimed is:

1. A molding composition for forming a mold and a core for casting, said molding composition comprising foundry sand, a binder for binding said foundry sand, said binder including as a major part a condensation-reactive compound having at least one methylol group in a molecule, a disintegration assistant for improving disintegration characteristics of the mold and the core produced by binding said foundry sand with said binder, said disintegration assistant including at least one compound selected from the group consisting of calcium hydroxide, calcium carbonate, barium hydroxide, and barium carbonate, and a compound capable of generating gas upon heating at a temperature ranging from about 200° to about 400° C.

2. A molding composition as claimed in claim 1, wherein weight ratio of said disintegration assistant to said condensation-reactive compound is within a range of from 0.5:100 to 35:100.

3. A molding composition as claimed in claim 1, wherein weight ratio of said gas generating compound to said condensation-reactive compound is within a range of from 0.5:100 to 35:100.

4. A molding composition as claimed in claim 3, wherein said weight ratio is within a range of from 5:100 to 15:100.

5. A molding composition as claimed in claim 1, wherein said condensation-reactive compound is at least one selected from the group consisting of phenol-formaldehyde resin, furfuryl alcohol-furfural copolycondensation resin, furfuryl alcohol resin, furfural-phenol copolycondensation resin, furfuralketone copolycondensation resin, furfuryl alcohol-formaldehyde resin, furfuryl alcohol-urea-formaldehyde resin, furfuryl alcohol-phenol-urea-formaldehyde resin, furfuryl alcohol-phenol-formaldehyde resin, melamine-formaldehyde resin, urea-formaldehyde resin, and resorcinol-formaldehyde resin.

6. A molding composition as claimed in claim 1, wherein said gas generating compound is at least one selected group consisting of potassium permanganate, barium permanganate, potassium oxide, bismuth oxide, aluminum hydroxide, magnesium hydroxide, lanthanum hydroxide, zinc carbonate, sodium hydrogencarbonate, selenium oxide, azodicarbonamide, D-glucose, L-sodium glutamate, dicyandiamide, d-potassium hydrogentartrate, sulfanilic acid, DL-methionine, n-quinonedioxime, and n, n'-dibenzoylquinonedioxime.

* * * * *